US009623272B2

(12) United States Patent
Drozdowski et al.

(10) Patent No.: US 9,623,272 B2
(45) Date of Patent: Apr. 18, 2017

(54) ADJUSTABLE PLATE FOR STARTING BLOCK

(71) Applicants: Jim Drozdowski, Clinton Corners, NY (US); Jonathan Mapes, Highland Mills, NY (US); Chris Jung, Brewster, NY (US); Jerry Amato, LaGrangeville, NY (US)

(72) Inventors: Jim Drozdowski, Clinton Corners, NY (US); Jonathan Mapes, Highland Mills, NY (US); Chris Jung, Brewster, NY (US); Jerry Amato, LaGrangeville, NY (US)

(73) Assignee: Pentair Water Pool and Spa, Inc., Cary, NC (US)

( * ) Notice: Subject to any disclaimer, the term of this patent is extended or adjusted under 35 U.S.C. 154(b) by 402 days.

(21) Appl. No.: 14/150,573

(22) Filed: Jan. 8, 2014

(65) Prior Publication Data

US 2015/0190665 A1 Jul. 9, 2015

(51) Int. Cl.

| | |
|---|---|
| ***E04H 4/14*** | (2006.01) |
| ***A63B 5/10*** | (2006.01) |
| ***A63K 3/02*** | (2006.01) |
| *A63B 69/12* | (2006.01) |

(52) U.S. Cl.

CPC ..... *A63B 5/10* (2013.01); *A63K 3/023* (2013.01); *A63B 69/12* (2013.01); *A63B 2210/50* (2013.01); *A63B 2225/09* (2013.01); *E04H 4/14* (2013.01)

(58) Field of Classification Search

CPC ..... A63B 5/10; A63B 31/00; A63B 69/10; A63B 69/14; A63B 2244/20; A63B 2244/203; A63B 2244/206

USPC ..... 248/235, 247, 250; 52/73, 650.3; 4/496; 482/26, 55, 30–32, 56, 148; 182/151

See application file for complete search history.

(56) References Cited

U.S. PATENT DOCUMENTS

| | | | | |
|---|---|---|---|---|
| 1,793,898 A * | 2/1931 | Barron | ..... | A63K 3/023 473/272 |
| 2,323,510 A * | 7/1943 | Arnett | ..... | A63K 3/023 482/19 |
| 2,900,187 A * | 8/1959 | Hondorp | ..... | A63K 3/023 482/19 |
| D202,546 S | 10/1965 | French | | |

(Continued)

FOREIGN PATENT DOCUMENTS

| | | | | |
|---|---|---|---|---|
| WO | 03092819 A2 | 11/2003 | | |
| WO | WO 2011012261 A2 * | 2/2011 | ..... | A63B 5/10 |
| WO | WO 2015159007 A1 * | 10/2015 | ..... | A63B 5/10 |

OTHER PUBLICATIONS

Machine Translation of WO2011/012261.*

(Continued)

*Primary Examiner* — Erin Deery

(74) *Attorney, Agent, or Firm* — Quarles & Brady LLP

(57) ABSTRACT

Some embodiments of the invention provide a starting block system for use with a swimming pool. A pedestal is designed to support a platform. A back plate is disposed along a rear edge of the platform and has a width dimension that is less than the width dimension of the platform. A slide mechanism is disposed adjacent the rear edge of the platform and is in communication with the back plate. The back plate is designed to slide laterally adjacent the rear edge of the platform.

19 Claims, 23 Drawing Sheets

(56) References Cited

U.S. PATENT DOCUMENTS

| | | | | |
|---|---|---|---|---|
| 3,401,931 | A | 9/1968 | McCafferty et al. | |
| 3,608,897 | A * | 9/1971 | Ross | A63K 3/023 482/19 |
| 3,799,542 | A | 3/1974 | Potgieter | |
| 3,809,392 | A | 5/1974 | Kral, Jr. | |
| 3,916,214 | A | 10/1975 | Coble, Jr. et al. | |
| D240,811 | S | 8/1976 | Beall | |
| 4,754,965 | A | 7/1988 | Moye | |
| 4,780,085 | A | 10/1988 | Malone | |
| 4,913,420 | A | 4/1990 | Moye | |
| 5,033,738 | A | 7/1991 | Newton, Jr. | |
| 5,465,964 | A | 11/1995 | Thompson | |
| 5,916,031 | A * | 6/1999 | Casillan | A63B 5/10 4/503 |
| 6,247,935 | B1 | 6/2001 | Martin et al. | |
| 6,494,812 | B1 | 12/2002 | Grimes, Jr. | |
| D471,945 | S | 3/2003 | Ryerson et al. | |
| 6,532,606 | B1 * | 3/2003 | Skovronski | A63B 5/10 4/488 |
| 7,193,167 | B1 * | 3/2007 | Brice | A63B 5/10 200/308 |
| 8,696,525 | B2 * | 4/2014 | Solanyk | A63K 3/023 482/55 |
| 8,795,140 | B2 * | 8/2014 | Solanyk | A63K 3/023 482/26 |
| 9,421,407 | B2 * | 8/2016 | Colletto | A63B 5/10 |
| 2003/0054922 | A1 * | 3/2003 | Ross | A63K 3/023 482/19 |
| 2005/0227813 | A1 | 10/2005 | Curry | |
| 2013/0252788 | A1 * | 9/2013 | Kaiel | A63B 5/10 482/55 |

OTHER PUBLICATIONS

Swiss Timing Ltd. Brochure for OSB11 Swimming Starting Block, 2 pages.

Spectrum Products Engineering Data for Startline Model—Omega SP.

Spectrum Products Engineering Data for Startline Model—Fusion by Spectrum.

* cited by examiner

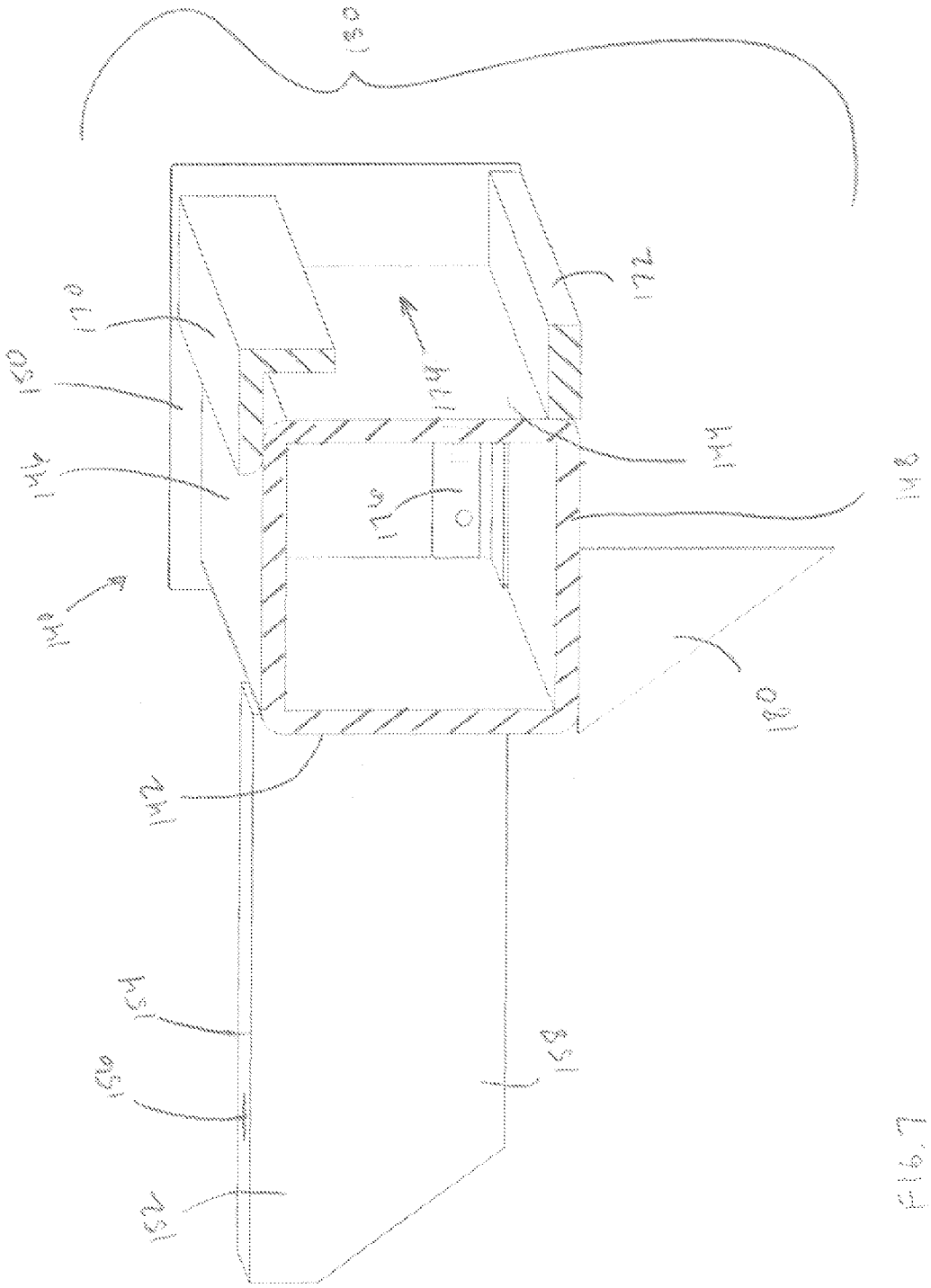
180
172
170
120
114
114a
114b
114c
114d
114e
114f
114g
114h
114i
114j
114k
114l
114m
114n
114o
114p
114q
114r
114s
114t
114u
114v
114w
114x
114y
114z
114aa
114ab
114ac
114ad
114ae
114af
114ag
114ah
114ai
114aj
114ak
114al
114am
114an
114ao
114ap
114aq
114ar
114as
114at
114au
114av
114aw
114ax
114ay
114az
114ba
114bb
114bc
114bd
114be
114bf
114bg
114bh
114bi
114bj
114bk
114bl
114bm
114bn
114bo
114bp
114bq
114br
114bs
114bt
114bu
114bv
114bw
114bx
114by
114bz
114ca
114cb
114cc
114cd
114ce
114cf
114cg
114ch
114ci
114cj
114ck
114cl
114cm
114cn
114co
114cp
114cq
114cr
114cs
114ct
114cu
114cv
114cw
114cx
114cy
114cz
114da
114db
114dc
114dd
114de
114df
114dg
114dh
114di
114dj
114dk
114dl
114dm
114dn
114do
114dp
114dq
114dr
114ds
114dt
114du
114dv
114dw
114dx
114dy
114dz
114ea
114eb
114ec
114ed
114ee
114ef
114eg
114eh
114ei
114ej
114ek
114el
114em
114en
114eo
114ep
114eq
114er
114es
114et
114eu
114ev
114ew
114ex
114ey
114ez
114fa
114fb
114fc
114fd
114fe
114ff
114fg
114fh
114fi
114fj
114fk
114fl
114fm
114fn
114fo
114fp
114fq
114fr
114fs
114ft
114fu
114fv
114fw
114fx
114fy
114fz
114ga
114gb
114gc
114gd
114ge
114gf
114gg
114gh
114gi
114gj
114gk
114gl
114gm
114gn
114go
114gp
114gq
114gr
114gs
114gt
114gu
114gv
114gw
114gx
114gy
114gz
114ha
114hb
114hc
114hd
114he
114hf
114hg
114hh
114hi
114hj
114hk
114hl
114hm
114hn
114ho
114hp
114hq
114hr
114hs
114ht
114hu
114hv
114hw
114hx
114hy
114hz
114ia
114ib
114ic
114id
114ie
114if
114ig
114ih
114ii
114ij
114ik
114il
114im
114in
114io
114ip
114iq
114ir
114is
114it
114iu
114iv
114iw
114ix
114iy
114iz
114ja
114jb
114jc
114jd
114je
114jf
114jg
114jh
114ji
114jj
114jk
114jl
114jm
114jn
114jo
114jp
114jq
114jr
114js
114jt
114ju
114jv
114jw
114jx
114jy
114jz
114ka
114kb
114kc
114kd
114ke
114kf
114kg
114kh
114ki
114kj
114kk
114kl
114km
114kn
114ko
114kp
114kq
114kr
114ks
114kt
114ku
114kv
114kw
114kx
114ky
114kz
114la
114lb
114lc
114ld
114le
114lf
114lg
114lh
114li
114lj
114lk
114ll
114lm
114ln
114lo
114lp
114lq
114lr
114ls
114lt
114lu
114lv
114lw
114lx
114ly
114lz
114ma
114mb
114mc
114md
114me
114mf
114mg
114mh
114mi
114mj
114mk
114ml
114mm
114mn
114mo
114mp
114mq
114mr
114ms
114mt
114mu
114mv
114mw
114mx
114my
114mz
114na
114nb
114nc
114nd
114ne
114nf
114ng
114nh
114ni
114nj
114nk
114nl
114nm
114nn
114no
114np
114nq
114nr
114ns
114nt
114nu
114nv
114nw
114nx
114ny
114nz
114oa
114ob
114oc
114od
114oe
114of
114og
114oh
114oi
114oj
114ok
114ol
114om
114on
114oo
114op
114oq
114or
114os
114ot
114ou
114ov
114ow
114ox
114oy
114oz
114pa
114pb
114pc
114pd
114pe
114pf
114pg
114ph
114pi
114pj
114pk
114pl
114pm
114pn
114po
114pp
114pq
114pr
114ps
114pt
114pu
114pv
114pw
114px
114py
114pz
114qa
114qb
114qc
114qd
114qe
114qf
114qg
114qh
114qi
114qj
114qk
114ql
114qm
114qn
114qo
114qp
114qq
114qr
114qs
114qt
114qu
114qv
114qw
114qx
114qy
114qz
114ra
114rb
114rc
114rd
114re
114rf
114rg
114rh
114ri
114rj
114rk
114rl
114rm
114rn
114ro
114rp
114rq
114rr
114rs
114rt
114ru
114rv
114rw
114rx
114ry
114rz
114sa
114sb
114sc
114sd
114se
114sf
114sg
114sh
114si
114sj
114sk
114sl
114sm
114sn
114so
114sp
114sq
114sr
114ss
114st
114su
114sv
114sw
114sx
114sy
114sz
114ta
114tb
114tc
114td
114te
114tf
114tg
114th
114ti
114tj
114tk
114tl
114tm
114tn
114to
114tp
114tq
114tr
114ts
114tt
114tu
114tv
114tw
114tx
114ty
114tz
114ua
114ub
114uc
114ud
114ue
114uf
114ug
114uh
114ui
114uj
114uk
114ul
114um
114un
114uo
114up
114uq
114ur
114us
114ut
114uv
114uw
114ux
114uy
114uz
114va
114vb
114vc
114vd
114ve
114vf
114vg
114vh
114vi
114vj
114vk
114vl
114vm
114vn
114vo
114vp
114vq
114vr
114vs
114vt
114vu
114vv
114vw
114vx
114vy
114vz
114wa
114wb
114wc
114wd
114we
114wf
114wg
114wh
114wi
114wj
114wk
114wl
114wm
114wn
114wo
114wp
114wq
114wr
114ws
114wt
114wu
114wv
114ww
114wx
114wy
114wz
114xa
114xb
114xc
114xd
114xe
114xf
114xg
114xh
114xi
114xj
114xk
114xl
114xm
114xn
114xo
114xp
114xq
114xr
114xs
114xt
114xu
114xv
114xw
114xx
114xy
114xz
114ya
114yb
114yc
114yd
114ye
114yf
114yg
114yh
114yi
114yj
114yk
114yl
114ym
114yn
114yo
114yp
114yq
114yr
114ys
114yt
114yu
114yv
114yw
114yx
114yy
114yz
114za
114zb
114zc
114zd
114ze
114zf
114zg
114zh
114zi
114zj
114zk
114zl
114zm
114zn
114zo
114zp
114zq
114zr
114zs
114zt
114zu
114zv
114zw
114zx
114zy
114zz

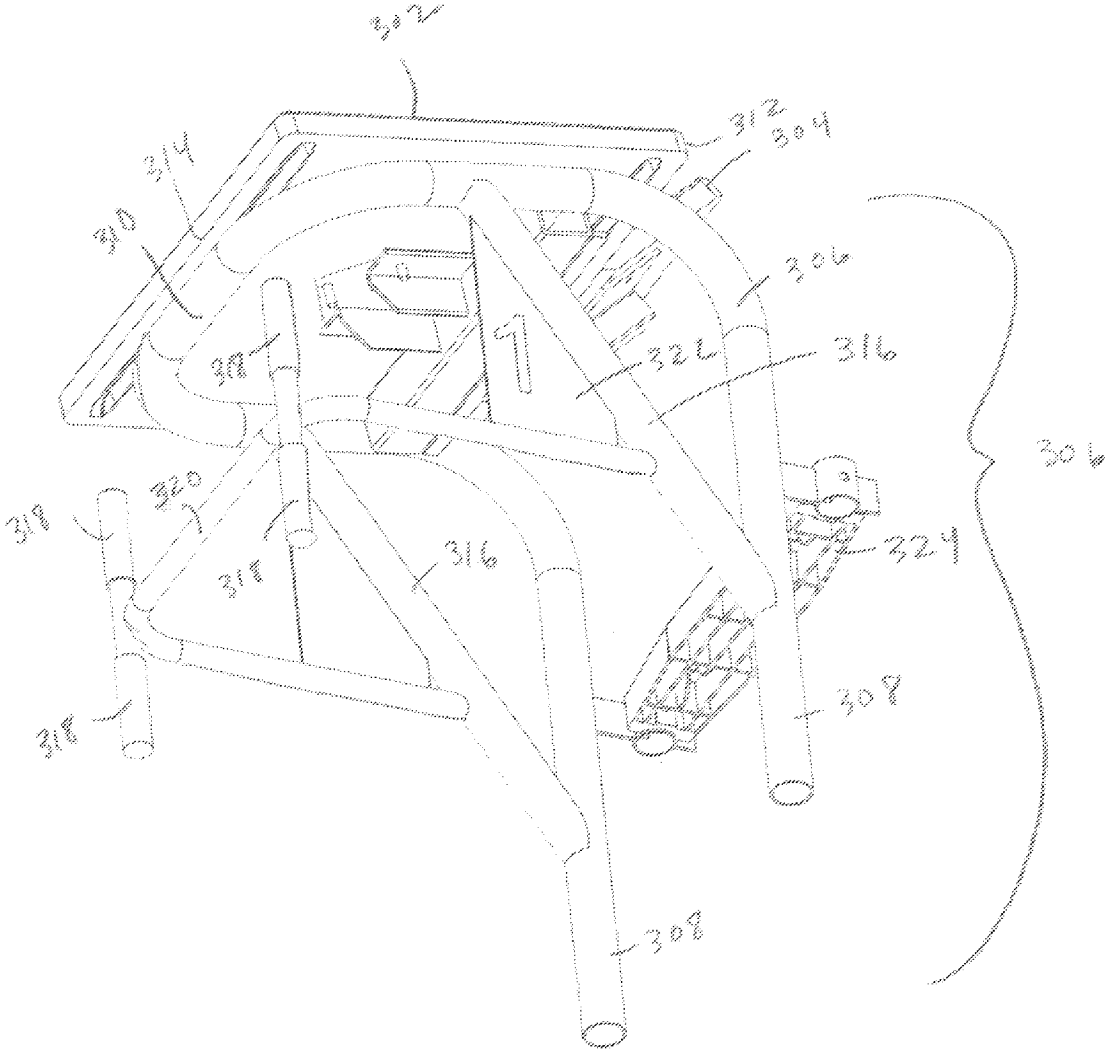
20b
22a
402
316
20b
316
402
22b
316
316
316

ADJUSTABLE PLATE FOR STARTING BLOCK

BACKGROUND

The competitive swimming rules allow an athlete (e.g., swimmer) to start numerous types of races from a position external to a swimming pool. In many instances, a starting block is utilized, which is a raised platform disposed adjacent an edge of the pool that supports the swimmer prior to starting the race. Numerous parameters regarding the dimensions and orientation of the starting block are specified by rules and regulations set forth by the swimming governing body.

A swimmer may start from one of numerous positions on the starting block. For example, the swimmer may position both feet adjacent a front edge of the starting block and push off the front edge when diving into the water. In other instances, the swimmer may position one foot (e.g., leading foot) adjacent the front edge of the starting block with the other foot (e.g., trailing foot) set back from the front edge for a "track start." In track starts, the leading foot contacts and pushes off the front edge, or a front section of the platform, while the trailing foot pushes off a raised portion of the starting block.

Some starting blocks include a raised surface in the form of a back plate and/or other raised surfaces that protrude from the starting block that act as a support surface for the trailing foot as the swimmer pushes off from the starting block. Typical back plates include an inclined or otherwise protruding surface that extends upwardly from the starting block. The swimmer is able to position the trailing foot onto the back plate to provide additional thrust when diving into the pool.

Many back plates known in the art protrude upwardly from an upper surface of the starting block at an incline and extend laterally across the entire width of the upper surface. Additionally, back plates that extend the entire width of the starting block have been used to accommodate swimmers who favor one foot or the other for pushing off. For example, a swimmer pushing off the starting block with the right foot would need a back plate disposed adjacent the right foot. Similarly, a swimmer pushing off the starting block with the left foot would need a back plate disposed adjacent the left foot. Therefore, swimming pools have used elongate back plates that span the width of the starting block to accommodate both types of swimmers.

However, there are some obstacles associated with these back plates due to their positioning and orientation. In particular, the back plate may make it awkward for a swimmer to mount the starting block due to the width of the back plate and the inclined nature thereof. In these instances, the swimmer may be forced to climb onto the starting block over the angled back plate.

Some starting block systems have attempted to address these deficiencies by providing an adjustable back plate. However, these back plates still span the entire width of the swimming block and typically only slide forward and away from the front edge of the starting block to shorten the distance between the front edge of the starting block and the back plate.

Therefore, there is a need for a starting block having an adjustable back plate that is capable of being positioned in such a way so as to not interfere with the swimmer when the swimmer is mounting the starting block. There is also a need for an adjustable back plate that is able to accommodate swimmers who push off the starting block with either foot.

There is a further need to provide a starting block system that can be easily retrofitted onto existing starting block systems that do not currently have a back plate.

SUMMARY

The invention relates generally to a starting block system for a swimming pool, and more specifically to a starting block system having an adjustable back plate having a width that is less than that of the platform. The adjustable back plate reduces the time, effort, and expense necessary to install and maintain starting block systems due to the flexibility of allowing the starting block to work with all types of swimmers, and/or be removed from the platform when not in use. The starting block system further allows a swimmer to easily mount the starting block without interference from the back plate and to position the back plate into a desired location.

Some embodiments of the invention provide a starting block system that includes a pedestal, a platform for holding a swimmer, and an adjustable plate assembly that includes a laterally slideable back plate.

Some other embodiments of the invention provide a starting block system for use with a swimming pool. A pedestal is designed to support a platform and a back plate is disposed along a rear edge of the platform. The back plate has a width dimension that is less than the width dimension of the platform. A slide mechanism is disposed adjacent the rear edge of the platform and is in communication with the back plate. The back plate is designed to slide laterally adjacent the rear edge of the platform.

Still further embodiments of the invention provide a kit for retrofitting a starting block system. The kit includes a slide mechanism having a housing with a slot extending laterally therethough. A back plate support includes a back plate and a slide plate. The kit further includes a plate for locking the slide mechanism to a platform. The slide plate is designed to be disposed within the slot of the housing.

These and other aspects of the invention will become apparent in light of the following detailed description.

DESCRIPTION OF THE DRAWINGS

FIG. 7 is a cross-sectional rear isometric view of the slide mechanism of FIG. 1 taken generally along the line 7-7 of FIG. 5;

FIG. 8 is a cross-sectional side elevational view of the slide mechanism of FIG. 1 taken generally along the line 8-8 of FIG. 5;

FIG. 23 is a bottom isometric view of the starting block system of FIG. 22.

DETAILED DESCRIPTION

Figure 1:
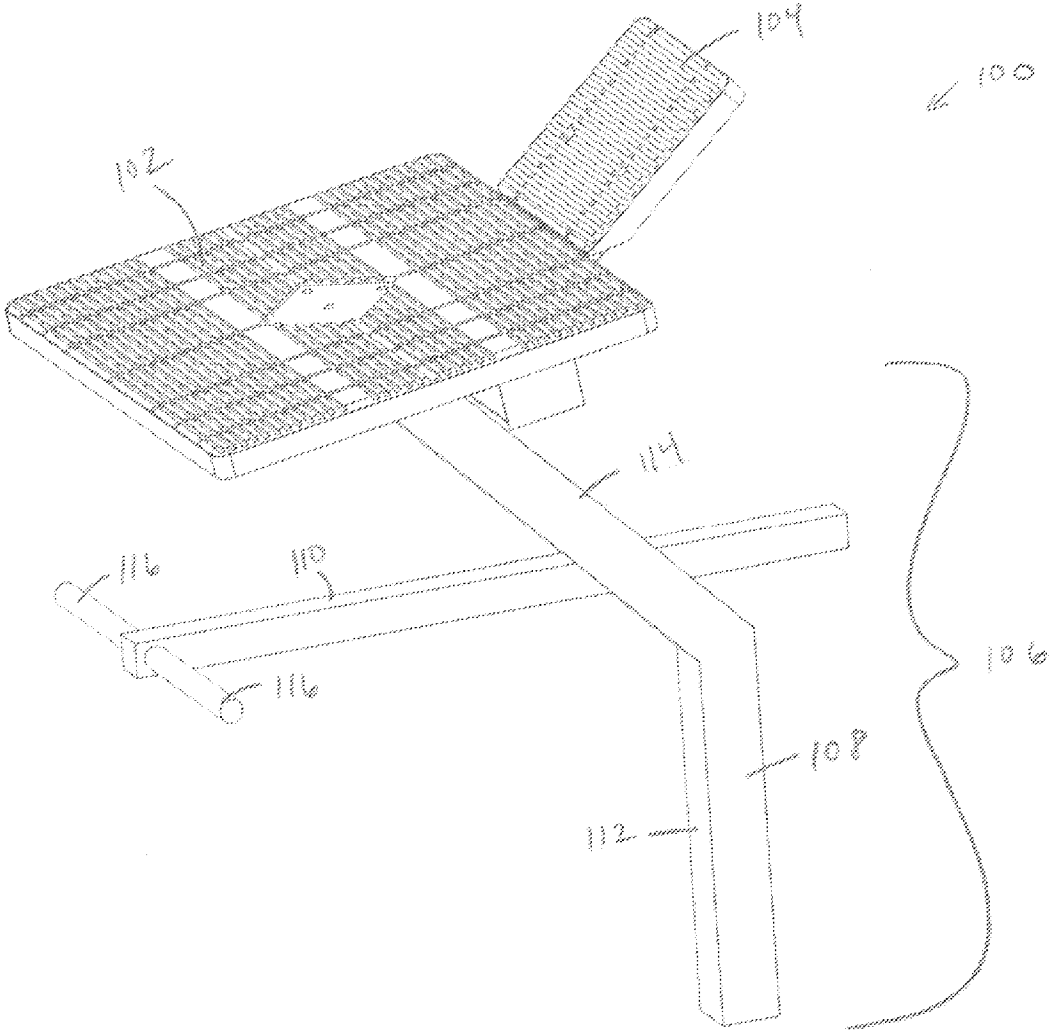
FIG. 1 is an isometric view of a starting block system according to one embodiment of the invention that includes a platform, an adjustable plate assembly, and a pedestal.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIGS. 1-22 illustrate a starting block system 100 according to one embodiment of the invention. The starting block system 100 includes a platform 102 having an adjustable plate assembly 104 associated therewith and a pedestal 106 that supports the platform 102 and plate assembly 104. The starting block system 100 is designed to be used as a launching surface or platform to enter a pool or other body of water. The starting block system 100 is also designed to support the weight of at least one swimmer. The starting block system 100 is preferably mounted to a substantially flat surface adjacent the body of water in manners known in the art. In some instances, the starting block system 100 is anchored into the ground adjacent the body of water (e.g., swimming pool). One or more components of the starting block system 100 may be sold together or may be sold as individual components.

Figure 2:
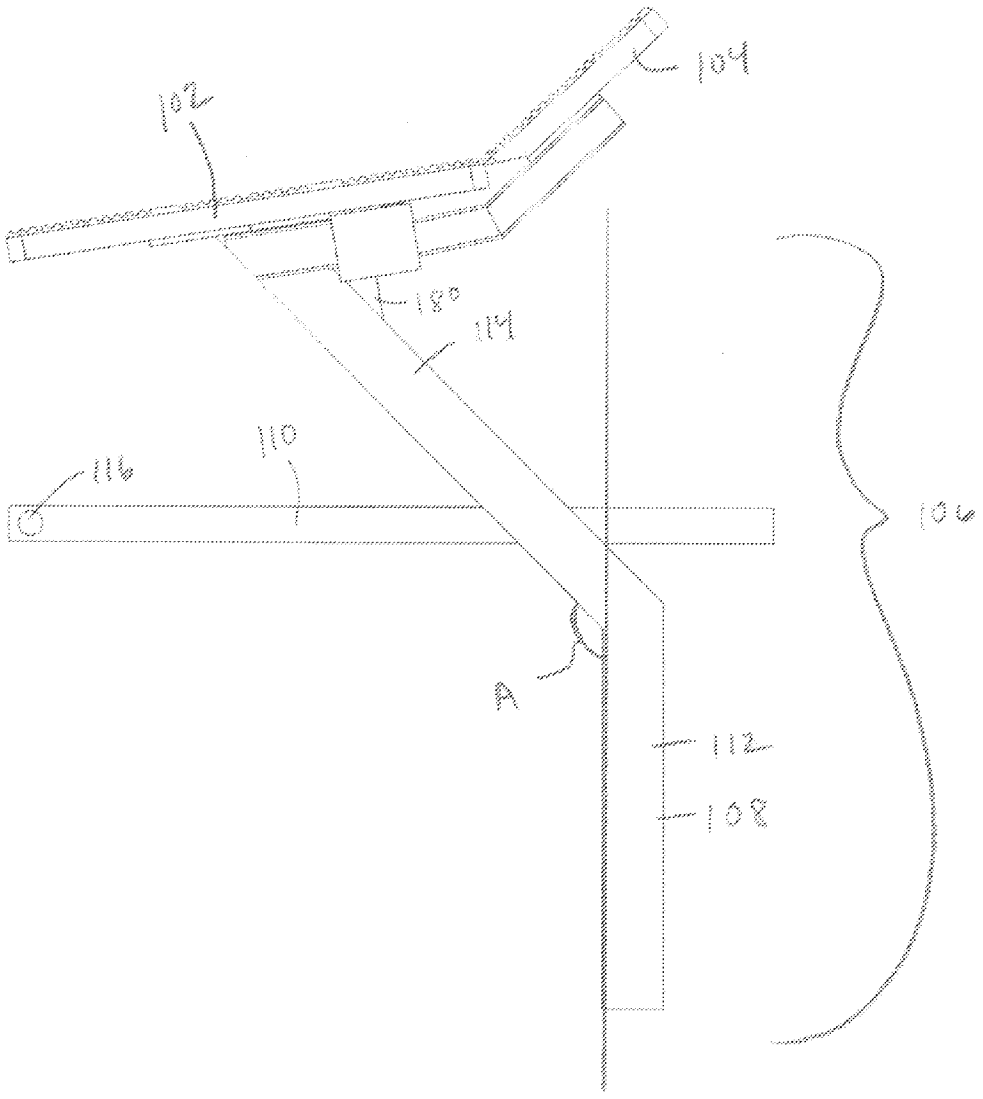
FIG. 2 is a side elevational view of the starting block system of FIG. 1.
Figure 3:
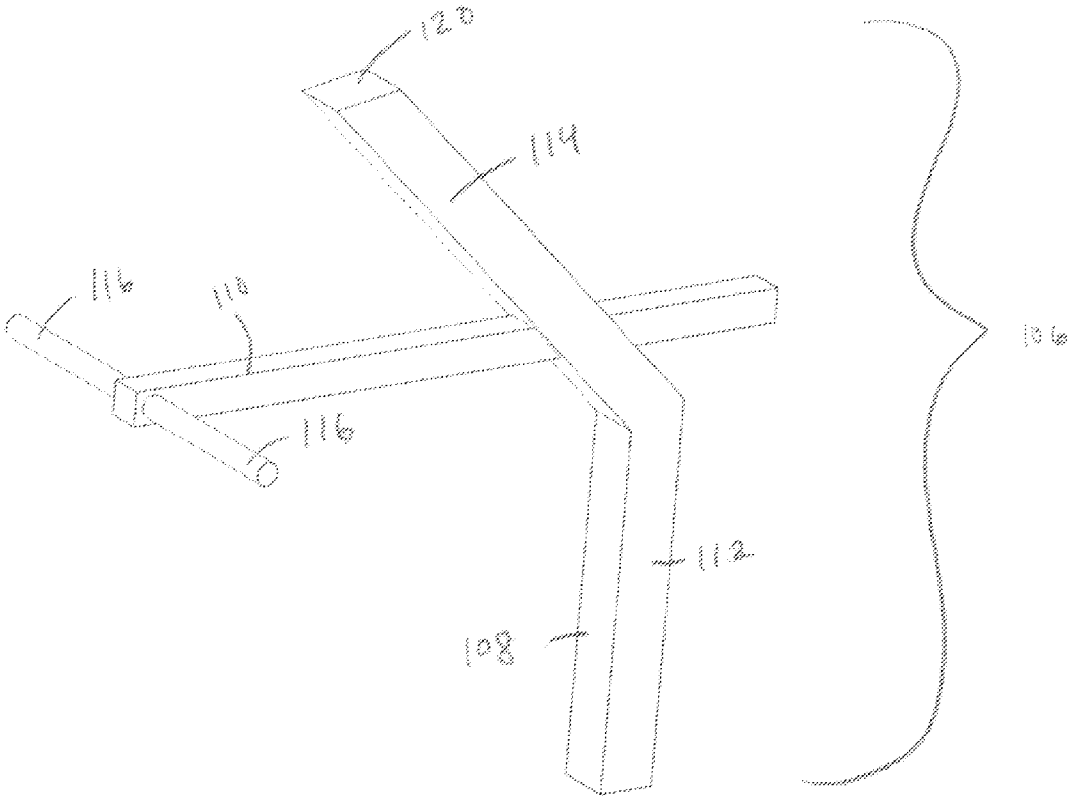
FIG. 3 is an isometric view of the pedestal of FIG. 1.

As best shown in FIGS. 2 and 3, the pedestal 106 includes a main support member 108 and a grip member 110. The main support member 108 is defined by a vertical section 112 that extends upwardly until terminating at an angled section 114. The main support member 108 may be characterized by a substantially square cross-sectional profile. An angle A (see FIG. 2) is formed between the intersection of the vertical section 112 and the angled section 114. In one embodiment, the angle A is between about 95 degrees to about 180 degrees (i.e., no bend). In another embodiment, the angle A is between about 100 degrees to about 150 degrees. In one particular embodiment, the angle A is about 130 degrees. The main support member 108 is designed to support the weight of at least one swimmer and is provided with an angled member in the embodiment depicted. It is also envisioned that the main support member 108 may protrude upwardly in a substantially vertical manner without an angled section.

Still referring to FIGS. 2 and 3, the grip member 110 extends outwardly from the angled section 114 of the main support member 108 in an area adjacent where the vertical section 110 intersects the angled section 114. The grip member 110 is also defined by a substantially square cross-section, similar to that of the main support member 108. However, the cross-sectional profile of the grip member 110 is smaller than that of the main support member 108.

The grip member 110 further includes two cylindrical handgrips 116 protruding outwardly from opposing sides of the grip member 110 adjacent an end thereof. The handgrips 116 are provided for a swimmer to grasp when the swimmer is disposed on the platform 102 and preparing to enter the pool, or when the swimmer is in the pool and preparing to start a race (e.g., backstroke). The handgrips 116 are depicted as cylindrical, but may be provided in other shapes and sizes and/or imparted with ridges, protrusions, depressions, or other surface interruptions. The handgrips 116 may also include a coating on at least a portion thereof that is designed to assist the swimmer in gripping. Suitable materials that may be used to cover the handgrips 116 include, for example, polymers and elastomers. In one specific embodiment, the handgrip 116 cover may be flexible polyvinyl chloride.

One or more portions of the pedestal 106 are made from a rigid material, such as steel. Each of the components may be integral with each other, or may be joined using methods known in the art (e.g., welding). Further, one or more components of the pedestal 106 may be provided with a coating to protect the components. One suitable material useful for the pedestal 106 includes stainless steel. In some embodiments, the stainless steel is T304 or T316L. In other embodiments, other materials may be used alone or in combination with the stainless steel.

As best seen in FIG. 3, the angled section 114 of the main support member 108 extends upwardly until terminating at a flat surface 120. The surface 120 is designed to support the platform 102 and to interact with the adjustable plate assembly 104 as discussed in detail below.

Figure 4:
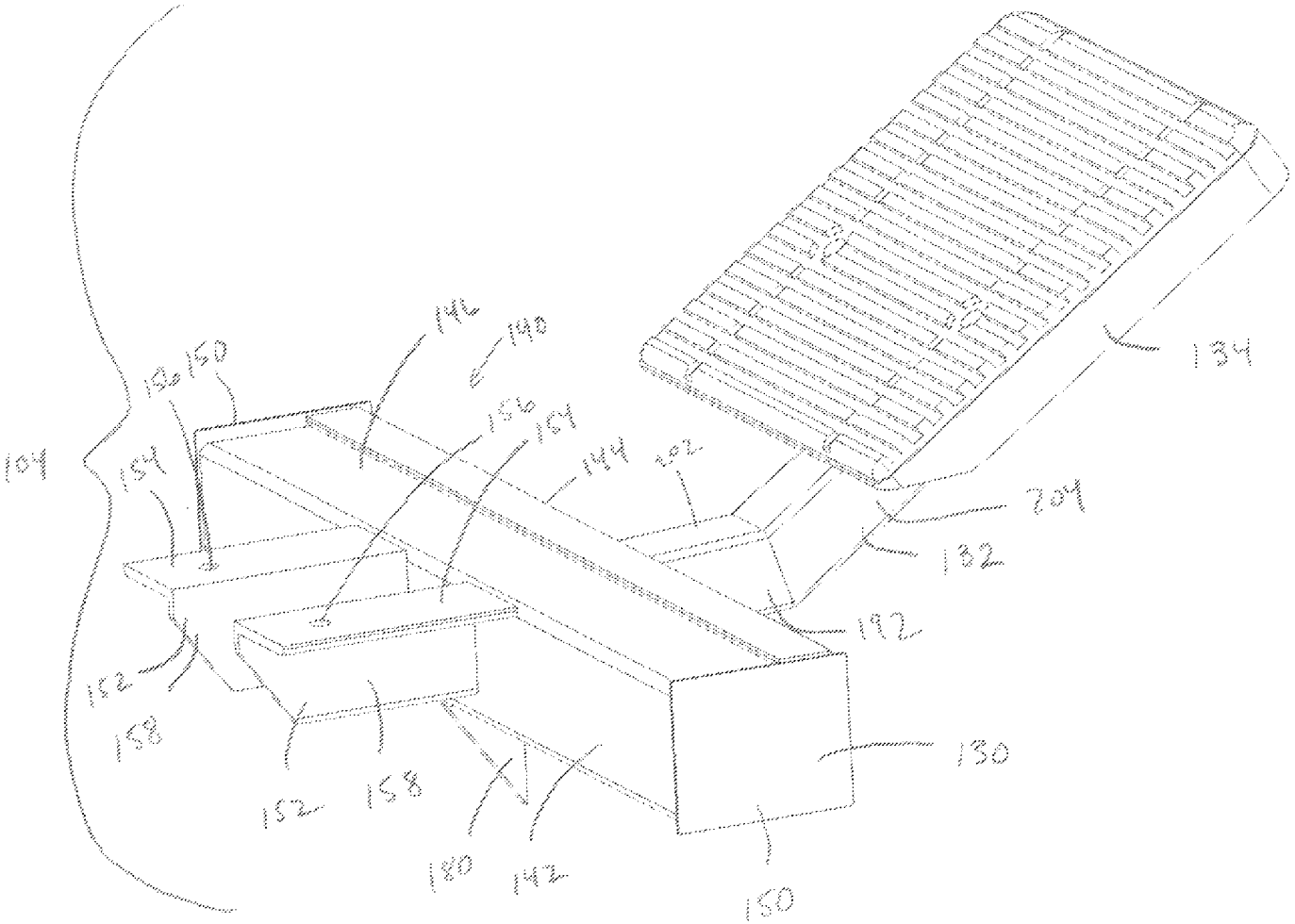
FIG. 4 is an isometric view of the adjustable plate assembly of FIG. 1 that includes a slide mechanism, a back plate support, and a back plate.

Now turning to FIG. 4, the adjustable plate assembly 104 is defined by a slide mechanism 130, a back plate support 132, and an adjustable back plate 134. The adjustable plate assembly 104 is designed to attach to the pedestal 106 in the orientation depicted in the Figures, such that the back plate 134 is adjacent a rear edge of the platform 102. In one embodiment, the starting block system 100 may be sold with the adjustable plate assembly 104. In other embodiments, existing starting block systems (not shown) not having an adjustable plate assembly 104 may be retrofitted with one or more components of the adjustable plate assembly 104 to enhance the flexibility thereof.

Figure 5:
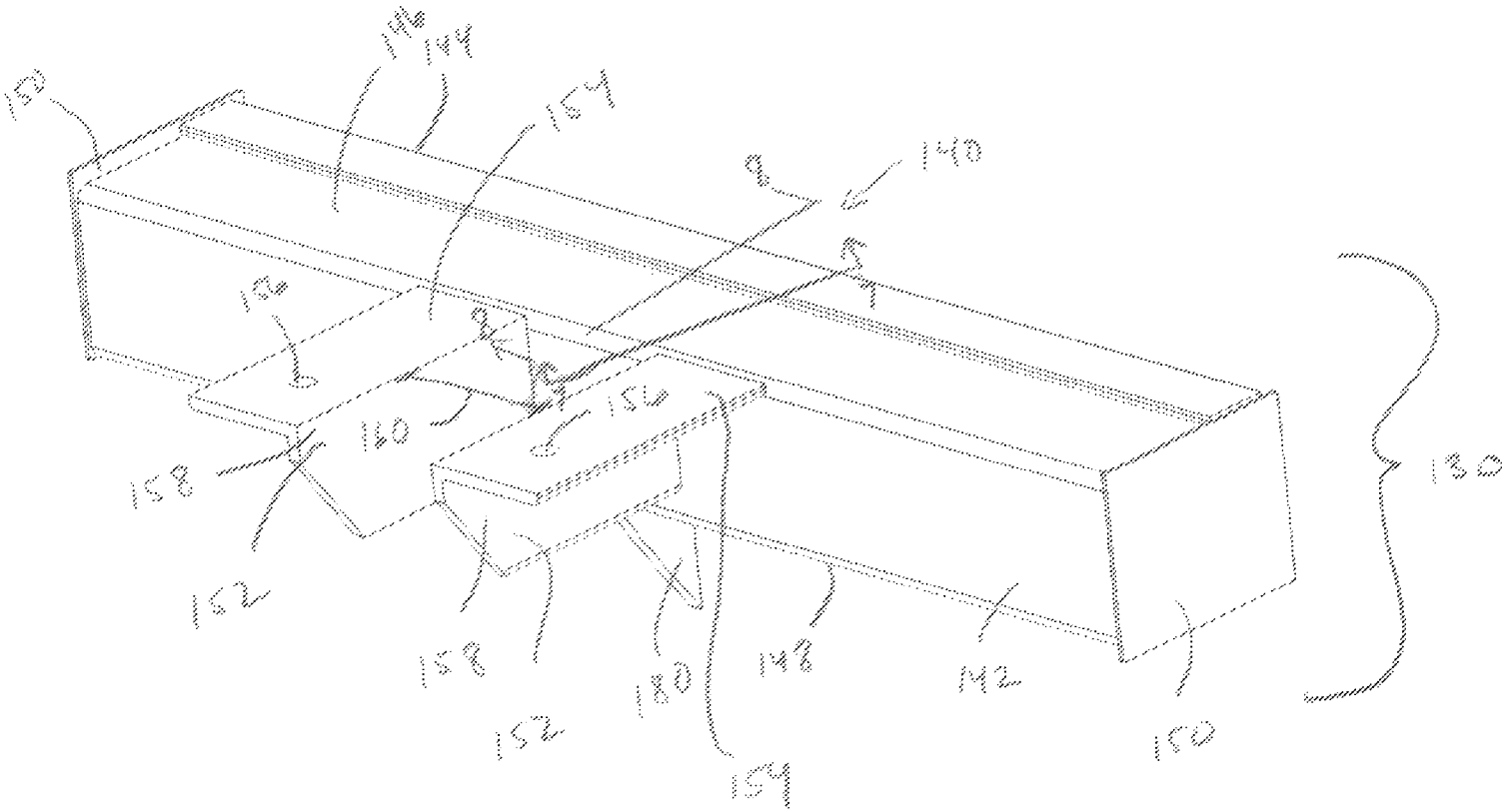
FIG. 5 is a front isometric view of the slide mechanism of FIG. 1.
Figure 6:
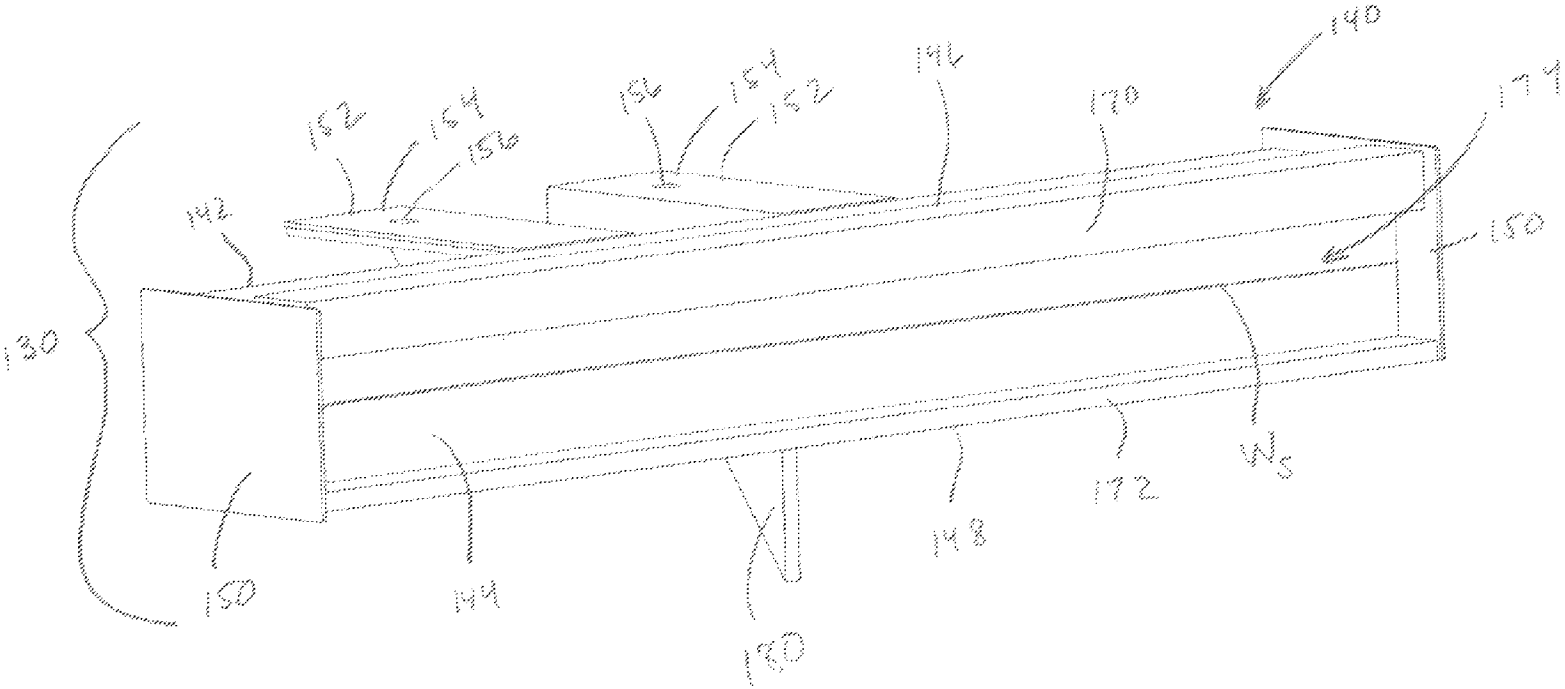
FIG. 6 is a rear isometric view of the of slide mechanism of FIG. 1.
Figure 2:
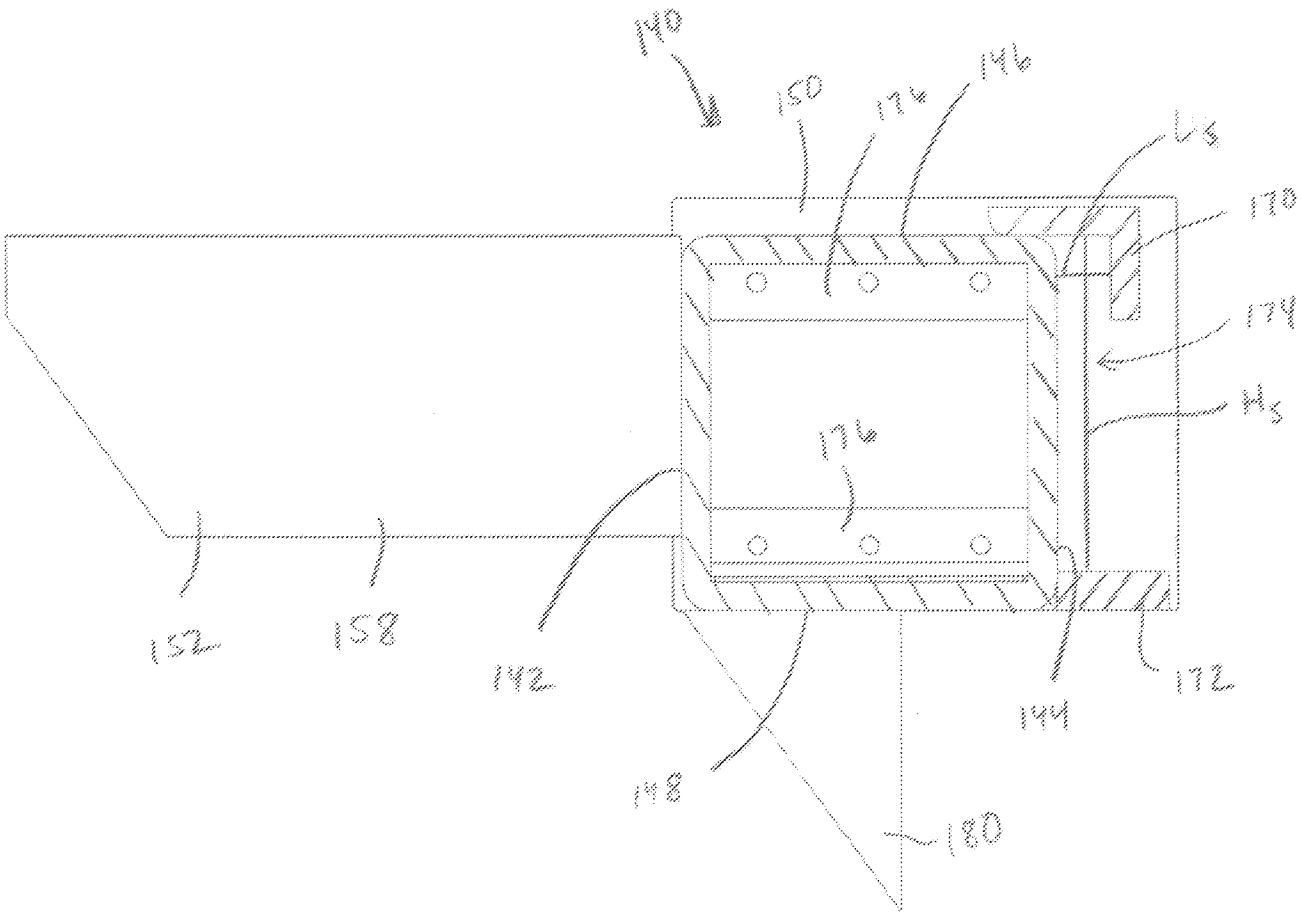

As best seen in FIGS. 5 and 6, the slide mechanism 130 is provided in the form of an elongate rectilinear housing 140 having a front surface 142, a rear surface 144, an upper surface 146, a lower surface 148, and two opposing end walls 150. The housing 140 is designed to accommodate the back plate support 132 adjacent the rear surface 144 and acts as the connection point to the platform 102 and pedestal 106 adjacent the front surface 142. In one embodiment, one or more of the end walls 150 may be removable to allow the back plate 134 to be removed from the housing 140. In this embodiment, one or more of the end walls 150 may be press-fit and/or otherwise removably joined to the housing 140.

One or more connection mechanisms are provided in the form of two substantially L-shaped brackets 152 that extend outwardly from the front surface 142 of the housing 140. The connection mechanisms are provided to allow the slide mechanism 130 to be attached to the platform 102. Each L-shaped bracket 152 includes a upper horizontal surface 154 with a circular opening 156. Each L-shaped bracket 152 further includes a vertical sidewall 158 protruding downwardly from the horizontal surface 154. The L-shaped brackets 152 may be provided integrally with the housing 140 or may be provided as separate components that are attached thereto. Further, at least one connection mechanism is provided, but additional connection mechanisms can be utilized depending on the design of the platform.

As shown in FIG. 5, a gap 160 is formed between interior surfaces of the vertical sidewalls 158 of the L-shaped brackets 152. The width of the gap 160 is designed to accommodate the width of the angled section 114 of the pedestal 106. In other embodiments, the width of the gap 160 may be adjusted to accommodate pedestals having varying sizes and/or shapes (e.g., triangular, circular, and the like).

Now turning to FIGS. 6, 7, and 8, the rear surface 144 of the housing 140 further includes an upper L-shaped member 170 and a lower flange 172 that collectively define a rectilinear slot 174. The slot 174 is designed to support and receive a portion of the back plate support 132, as described further below. The L-shaped member 170 and lower flange 172 may be integral with the housing 140 or may be provided as separate components.

The dimensions of the slot 174 are provided in such a manner so as to provide structural support for the back plate support 132 and the back plate 134 when the back plate support 132 is disposed within the slot 174. The slot 174 allows the back plate support 132 (and back plate 134) to slide back and forth along the width thereof from one side of the housing 140 to the other side of the housing 140. The slot 174 includes a height dimension $H_S$ (see FIG. 8) of between about 2 cm to about 10 cm as measured from the interior surface of the L-shaped member 170 and the lower flange 172. In another embodiment, the height dimension $H_S$ is between about 4 cm to about 6 cm. In a further embodiment, the slot 174 includes a height dimension $H_S$ of about 5.7 cm. Additionally, the slot 174 includes a length dimension $L_S$ of between about 0.5 cm to about 1.5 cm as measured from the end walls 150. In another embodiment, the length dimension $L_S$ is between about 0.8 cm to about 1.1 cm. In a further embodiment, the slot 174 includes a length dimension $L_S$ of about 0.95 cm. Similarly, the slot 174 includes a width dimension $W_S$ of between about 45 cm to about 55 cm as measured from the interior surface of the L-shaped member 170 to the rear surface 144 of the housing 140 (see FIG. 6). In another embodiment, the width dimension Ws is between about 42 cm to about 46 cm. In a further embodiment, the slot 174 includes a width dimension Ws that is between about 40 cm to about 60 cm.

In one embodiment, the L-shaped member 170 and lower flange 172 are attached to the end walls 150 of the slide mechanism 130 and are attached to the rear surface 144 of the housing 140. In some instances, the end walls 150 can be secured to the housing 140 in manners known in the art (e.g., welding, adhesive, interference etc.). In one particular embodiment, the end walls 150 may be provided with the L-shaped member 170 and lower flange 172, and joined to the housing 140 via one or more braces 176 (see FIGS. 7 and 8). In another embodiment, one or more of the L-shaped member 170, lower flange 172, and/or the end walls 150 may be provided as separate components from the housing 140 and may be attached in manners known in the art. It is contemplated that one or more components depicted in FIG. 6 may be provided to a user separately as a retrofitting kit that may be used on a pre-existing pedestal 106. Additional components may be included in the kit as needed including any hardware necessary to secure the housing 140, instructions, and associated components relating to the pedestal 106.

The slide mechanism 130 also optionally includes a substantially triangular support 180 designed to provide additional stability for the platform 102 and slide mechanism 130. The support 180 protrudes outwardly from the lower surface 148 of the housing 140 and interacts with the angled section 114 of the pedestal 106. The support 180 may be integrally formed with the pedestal 106 or may be integral with the housing 140 of the slide mechanism 130. In some instances, the support 180 may be added to an existing starting block system 100 in manners known in the art. In some embodiments, the support 180 is imparted with a shape that corresponds to the shape of the interacting surface of the pedestal 106.

Figure 9:
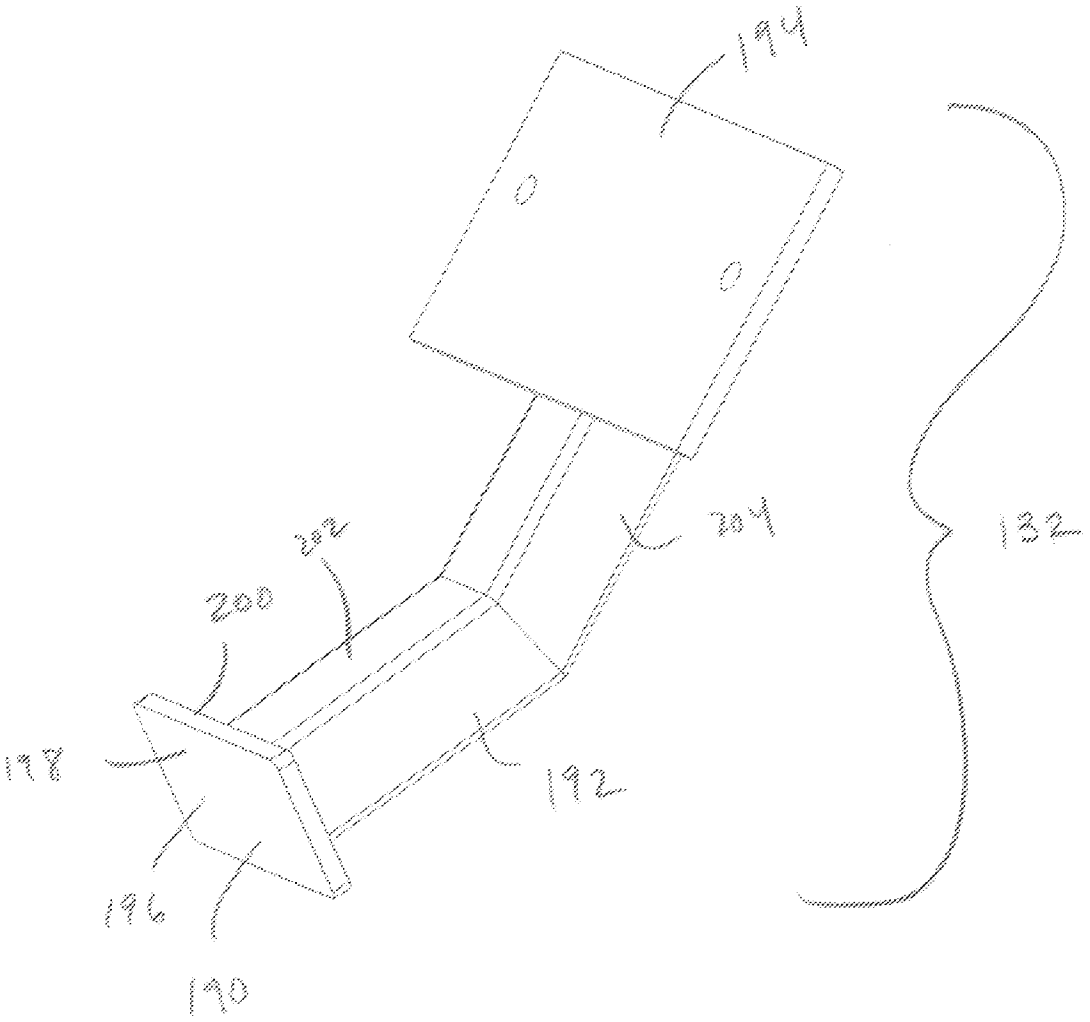
FIG. 9 is an isometric view of the back plate support of FIG. 4.
Figures 9, 10:
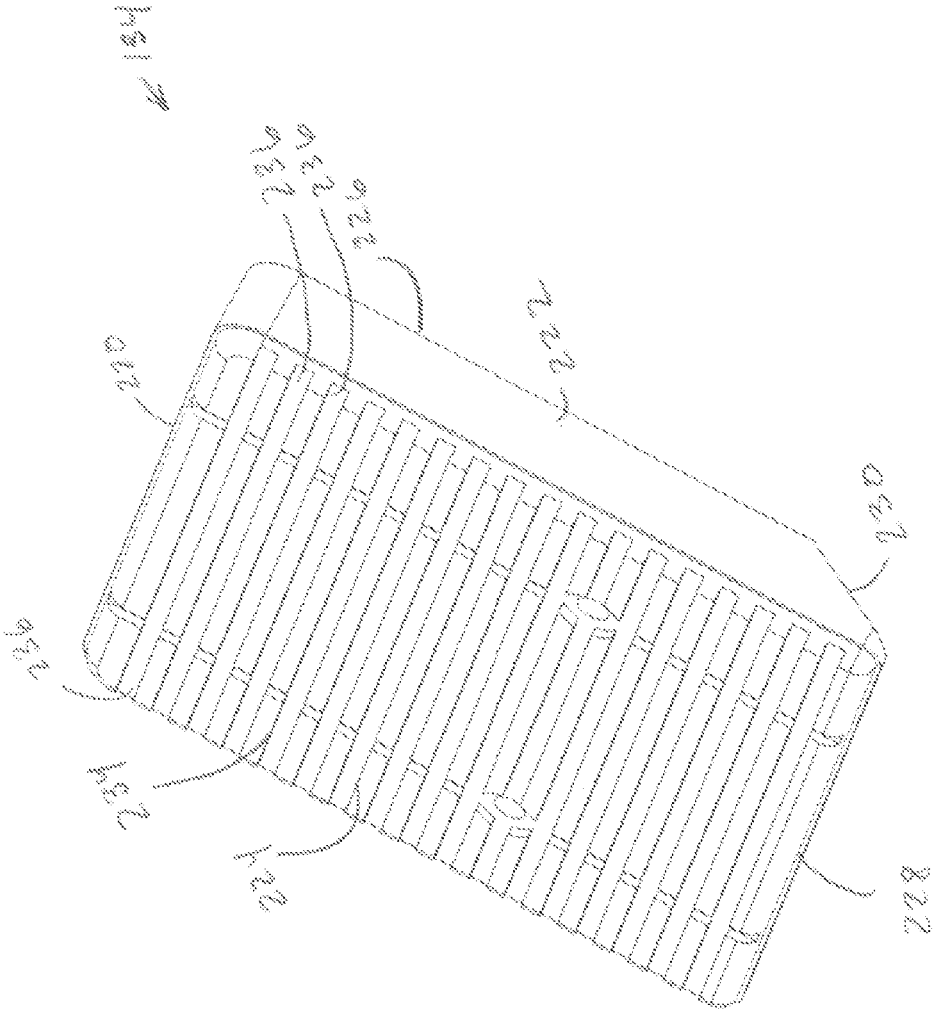
FIG. 10 is an isometric view of the back plate of FIG. 4.
Figure 11:
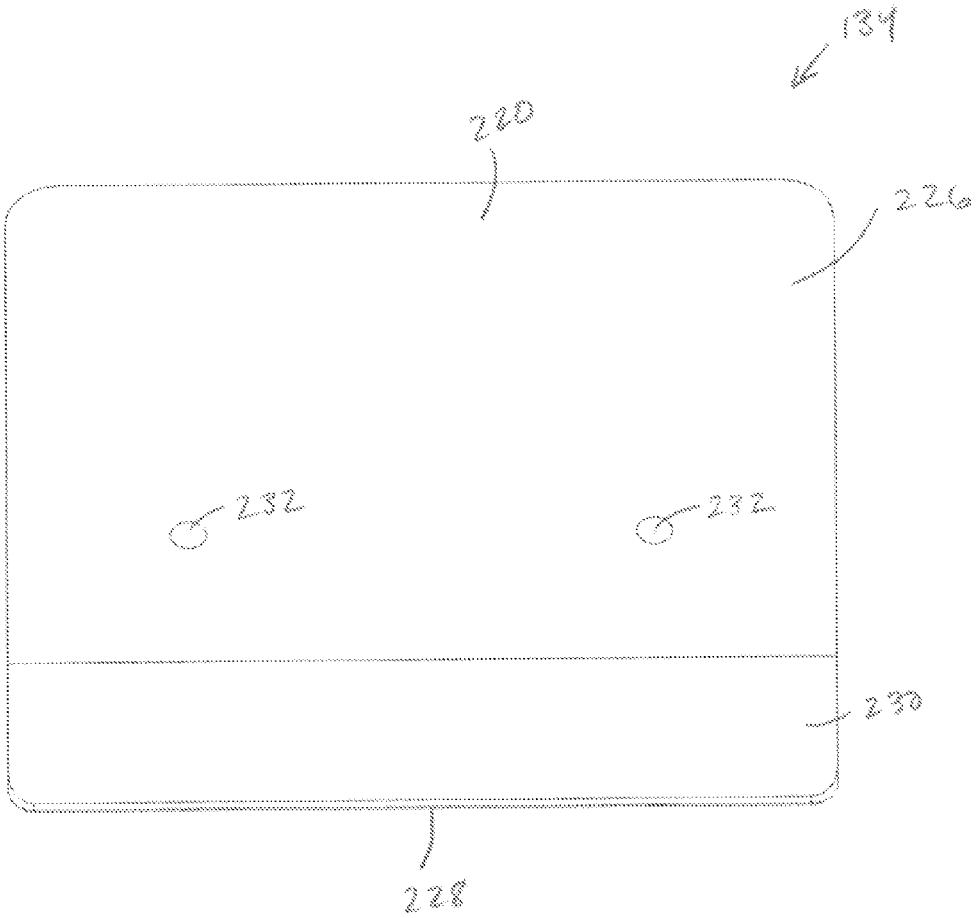
FIG. 11 is a rear elevational view of the back plate of FIG. 4.

Now turning to FIG. 9, the back plate support 132 includes a slide plate 190, a tubular support 192, and a mounting plate 194. The back plate support 132 is designed to interact with and extend from the slide mechanism 130 from one end, and to retain the back plate 134 at the opposing end. The slide plate 190 includes a substantially rectangular body 196 that is defined by a front surface 198 and rear surface 200. The tubular support 192 is attached to and extends from the rear surface 200 of the slide plate 190. The tubular support 192 includes a lower member 202 and an upper member 204 having a substantially square cross-sectional profile. The upper member 204 is provided at an angle with respect to the lower member 202 and is designed to position the back plate 134 adjacent a rear edge of the platform 102, as discussed in more detail below.

The mounting plate 194 is disposed at a distal end of the upper member 204 of the tubular support 192. The mounting plate 194 is provided as a substantially square body 206 having two openings 208 therein. The openings 208 allow the back plate 134 to be attached to the mounting plate 194 via screws (not shown). In another embodiment, the back plate 134 may be integral with the mounting plate 194 and/or the back plate 134 may be joined to the tubular support 192 directly. The mounting plate 194 may be provided in any shape or size that adequately supports and allows attachment of the back plate 134 thereto.

A shown in FIGS. 10-13, the back plate 134 is defined by a substantially square body 220 having a sidewall 222 that joins a front surface 224 and a rear surface 226. The sidewall 222 terminates adjacent a front edge 228 to form an angled end piece 230. The rear surface 226 optionally includes cylindrical recesses 232 (see FIG. 11) designed to accommodate screws (not shown) to anchor the back plate 134 to the mounting plate 194.

The front surface 224 of the back plate 134 includes a coating 234 designed to impart a gripping surface to the back plate 134. The coating 234 includes a plurality of elongate channels 236 extending across the front surface 224. The channels 236 are provided to act as a drainage mechanism for water and to act as a gripping surface for the foot of a swimmer. The coating 234 may be imparted to one or more portions of the front surface 224 and comprises any material that provides the desired gripping and draining properties.

Figures 12, 13:
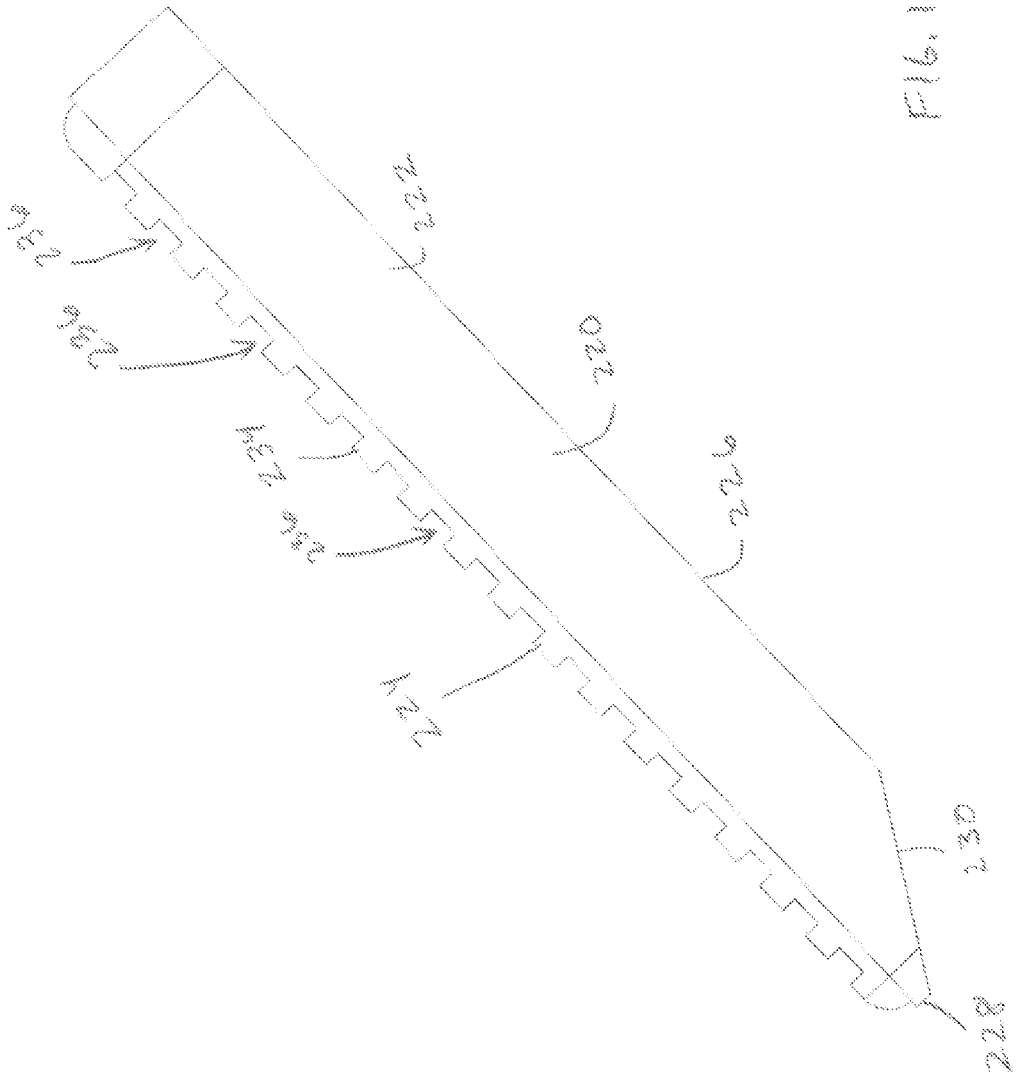
FIG. 12 is a side elevational view of the back plate of FIG. 4.
FIG. 13 is a front elevational view of the back plate of FIG. 4.
Figure 13:
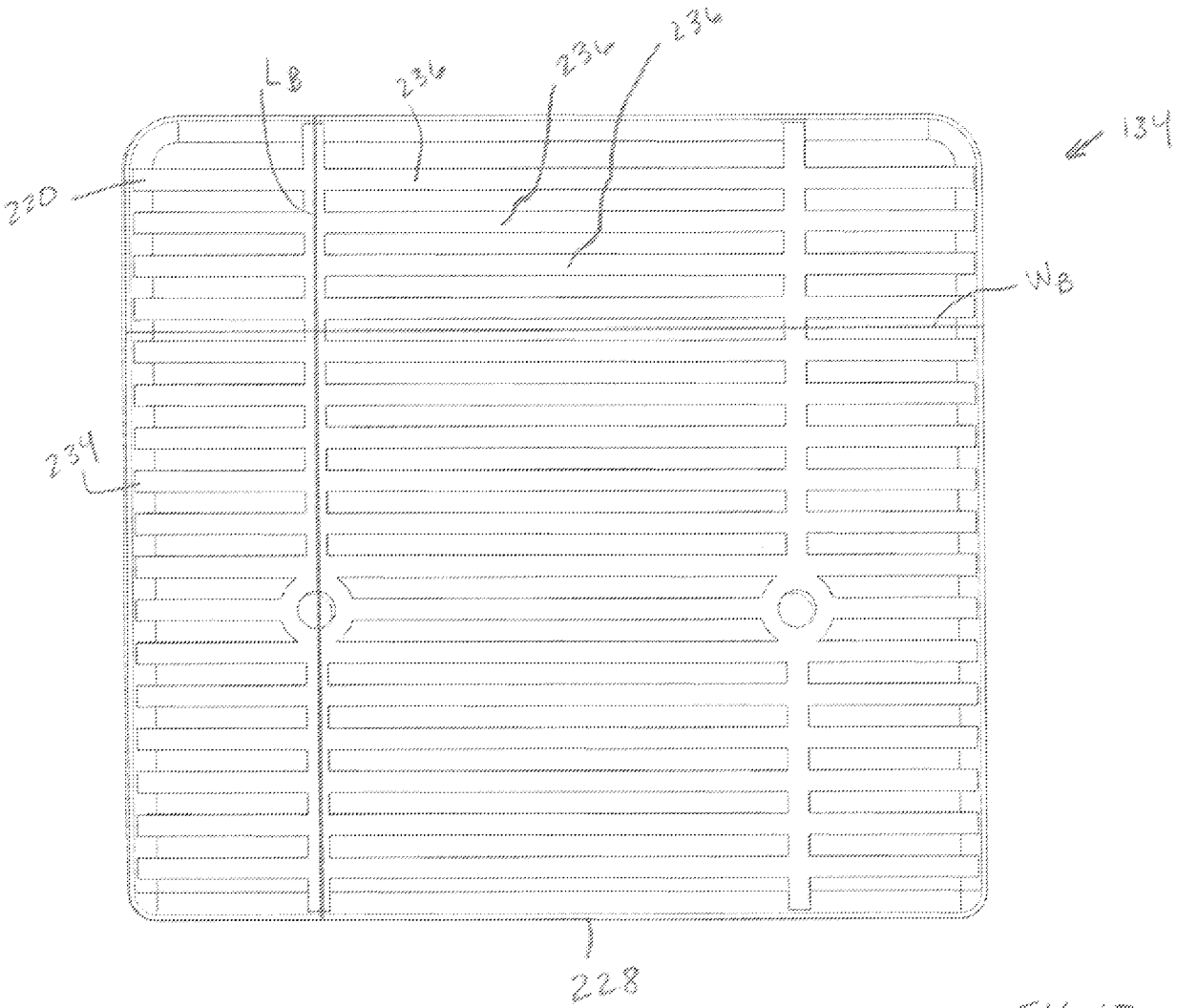
Figure 14:
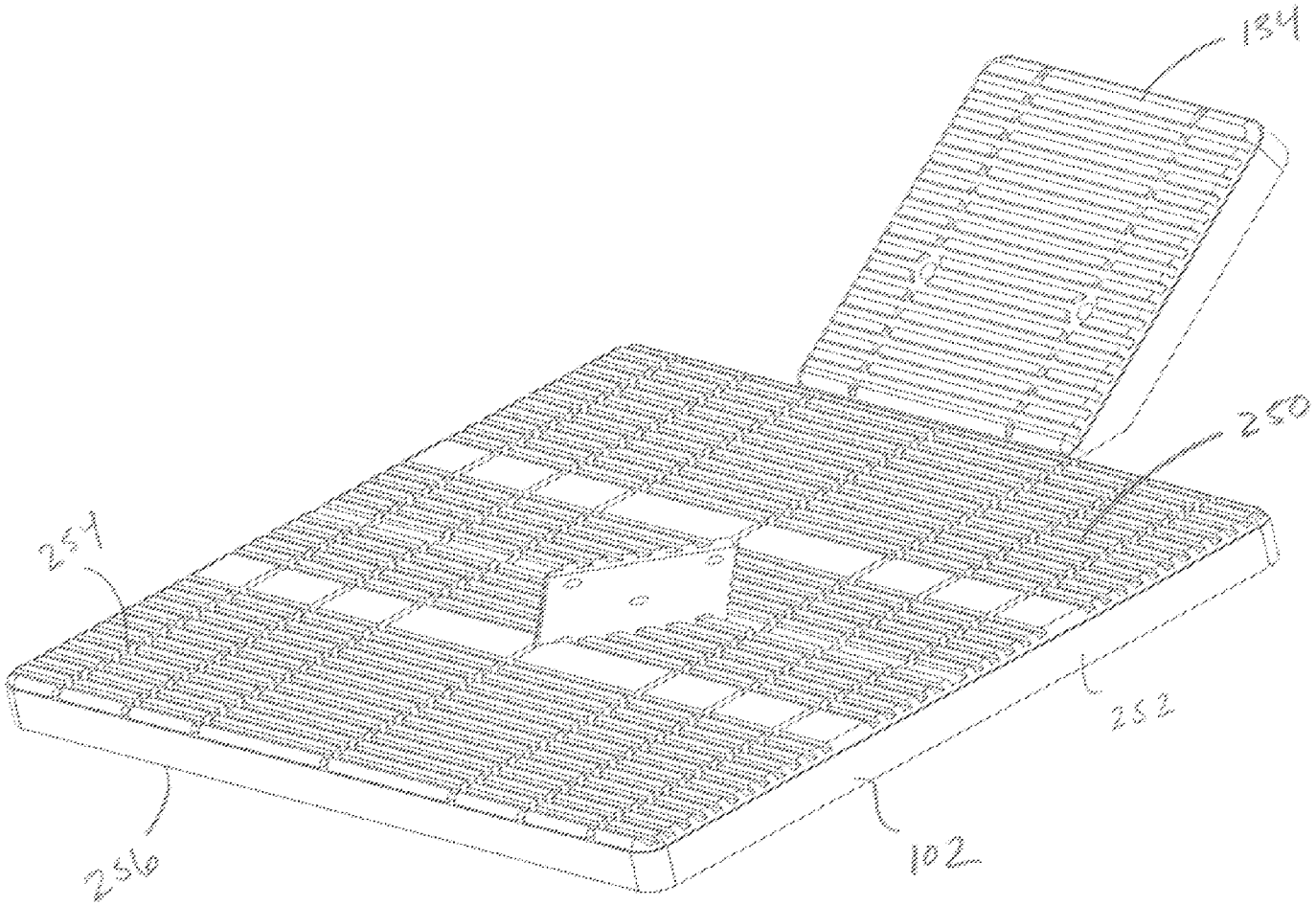
FIG. 14 is an isometric view of the back plate of FIG. 4 and the platform of FIG. 1.
Figure 15:
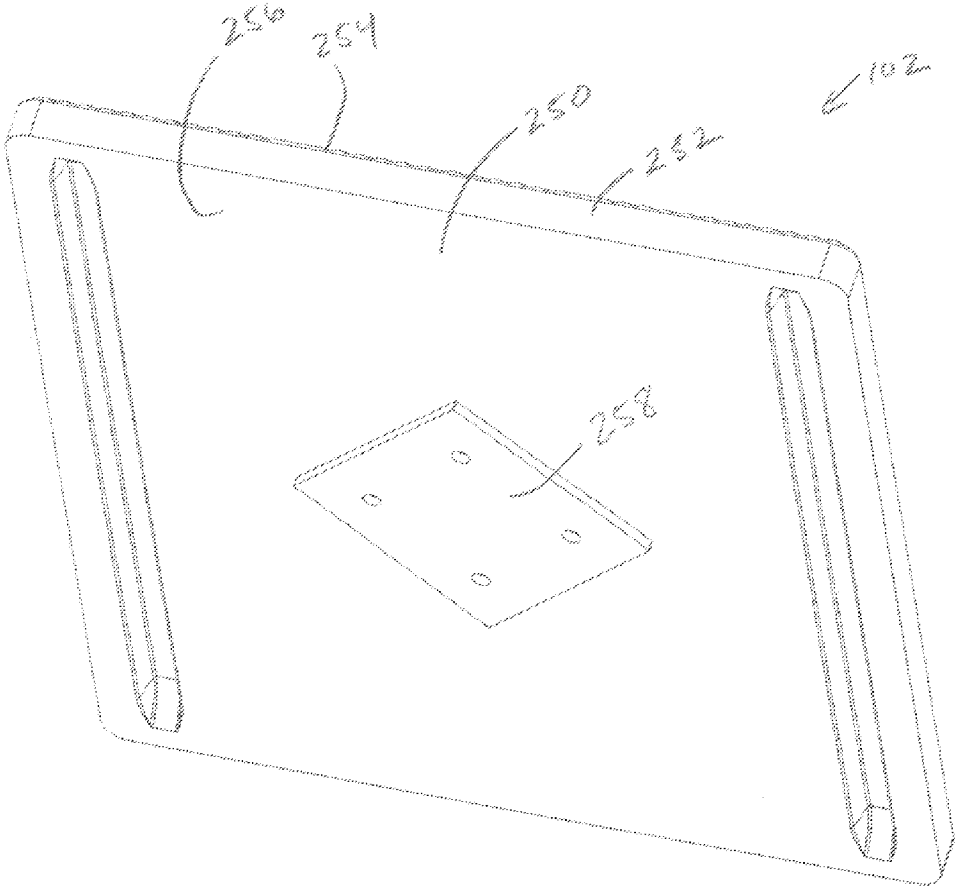
FIG. 15 is a bottom isometric view of the platform of FIG. 1.

As shown in FIG. 13, the back plate 134 is defined by a length dimension $L_P$ of between about 10 cm to about 50 cm as measured from opposing upper and lower edges thereof. In another embodiment, the length dimension $L_B$ is between about 20 cm to about 30 cm. In a further embodiment, the length dimension $L_B$ of the back plate 134 is about 24 cm. Similarly, the back plate 134 includes a width dimension $W_B$ of between about 10 cm to about 50 cm as measured from opposing side edges. In another embodiment, the width dimension $W_B$ is between about 20 cm to about 40 cm. In a further embodiment, the width dimension $W_B$ of the back plate 134 is about 25 cm. Additionally, the back plate 134 is defined by a surface area of between about 150 $cm^2$ to about 1000 $cm^2$. In another embodiment, the surface area is between about 400 $cm^2$ to about 800 $cm^2$. In a further embodiment, the surface area of the back plate 134 is about 600 $cm^2$.

Now turning to FIGS. 14-17, the back plate 134 is designed to be disposed adjacent the platform 102, and together form the launching surface for the swimmer. Similar to the back plate 134, the platform 102 is defined by a substantially square body 250 having a sidewall 252 that joins a front surface 254 and a rear surface 256. The sidewall 252 circumscribes the body 250 around the entirety thereof. A platform mounting plate 258 (see FIG. 15) is associated with the rear surface 256 of the platform 102 and is used to join the platform 102 to the angled section 114 of the pedestal 106 via lugs 260 (see FIG. 17). The platform mounting plate 258 and/or the lugs 260 may be provided in conjunction with other components discussed previously in the retrofitting kit.

The platform 102 further includes a coating 270 that may be similar to the coating 234 associated with the back plate 134. The coating 270 is designed to impart a gripping surface to the platform via raised surfaces 272 and corresponding channels 274. The coating 270 may be imparted to one or more portions of the front surface 254 and comprises any material that provides the desired gripping and draining properties.

Figure 16:
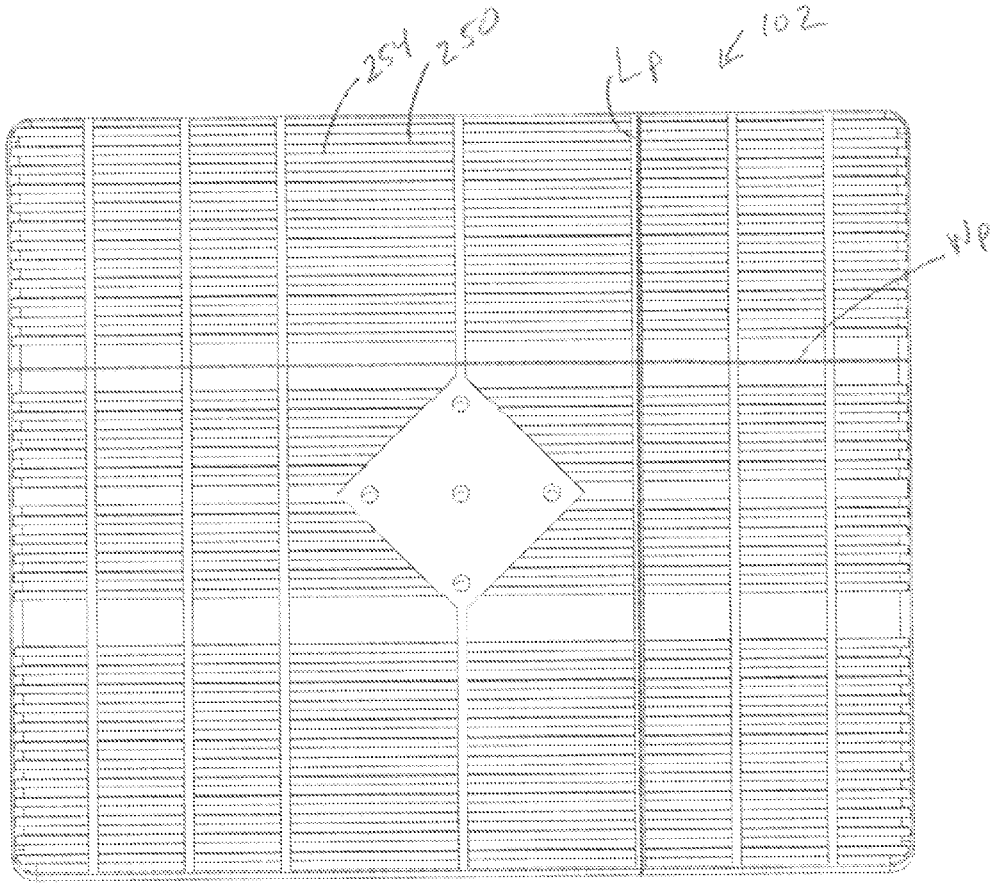
FIG. 16 is a front elevational view of the platform of FIG. 1.
Figure 17:
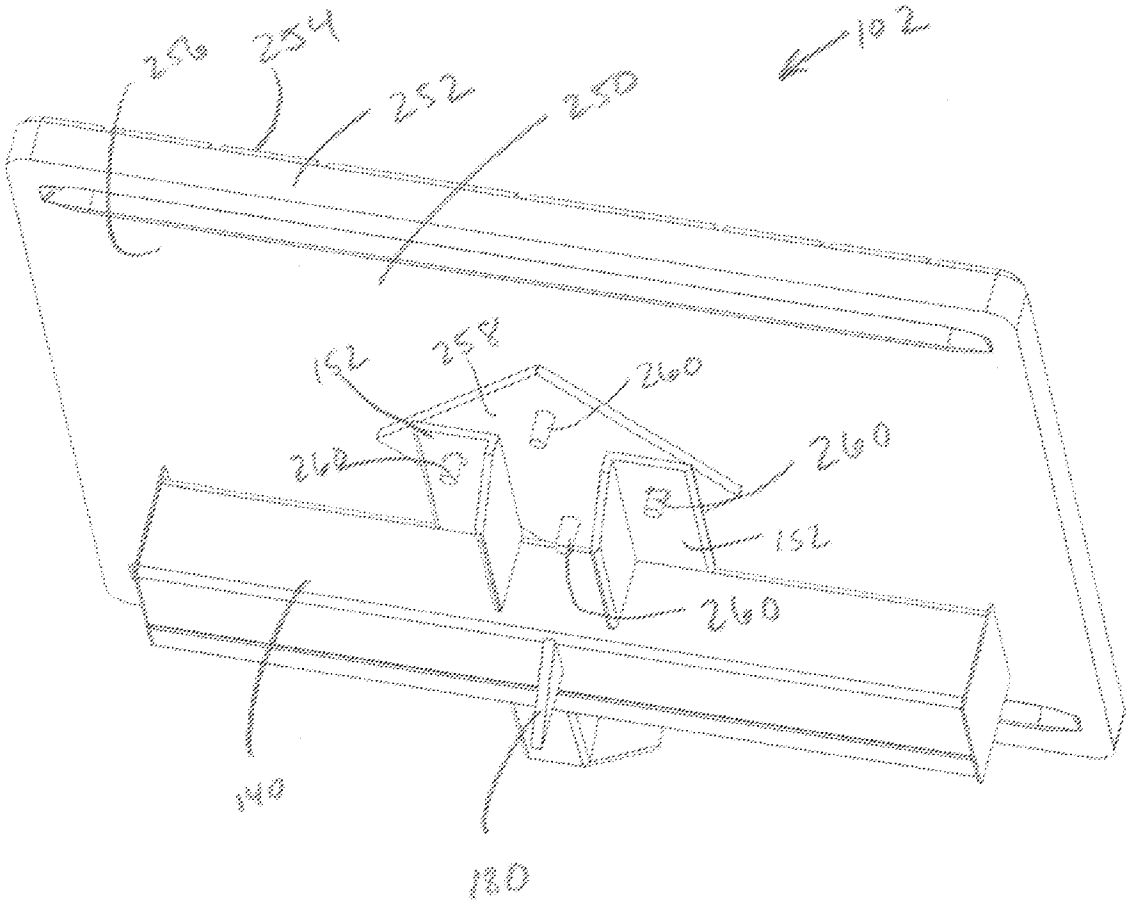
FIG. 17 is a bottom isometric view of the platform and adjustable plate assembly of FIG. 1.
Figure 18:
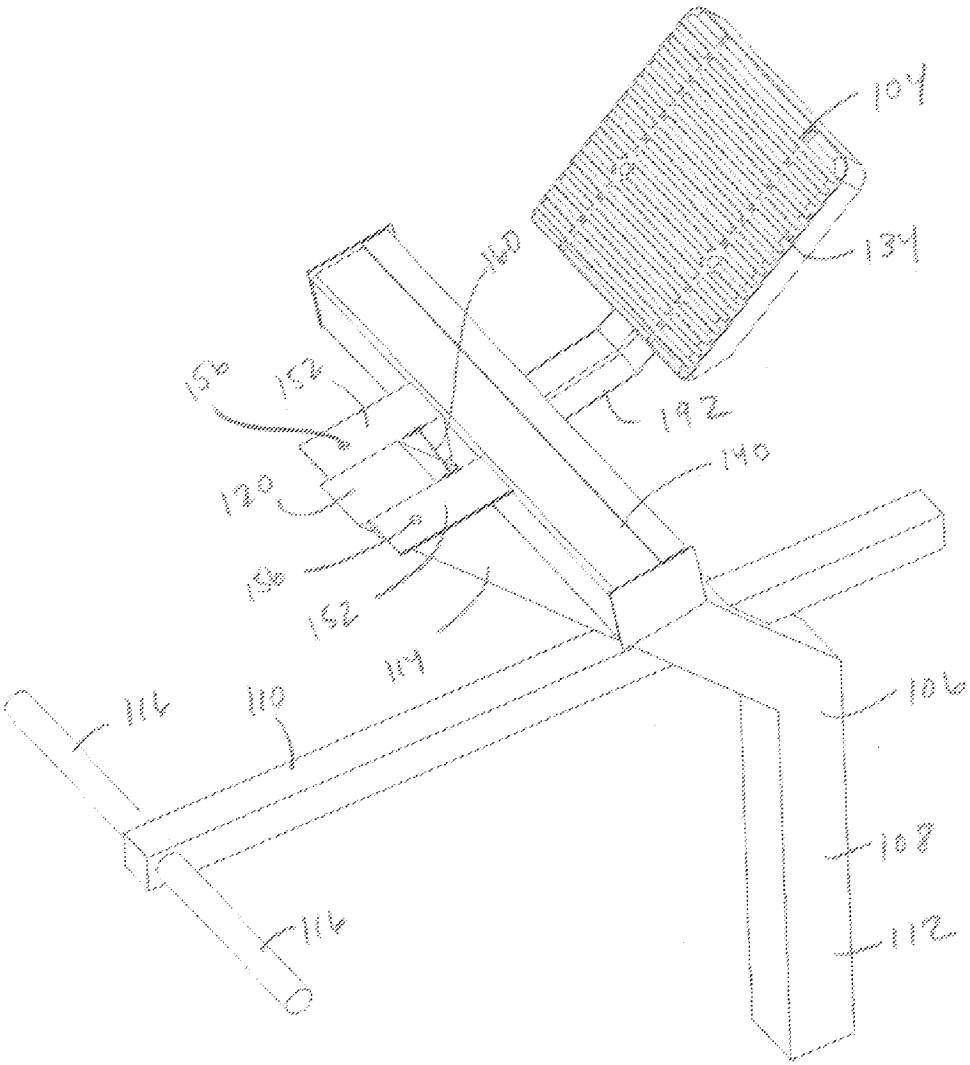
FIG. 18 is a top isometric view of the starting block system of FIG. 1, with the platform and platform mounting plate removed for clarity.
Figure 19:
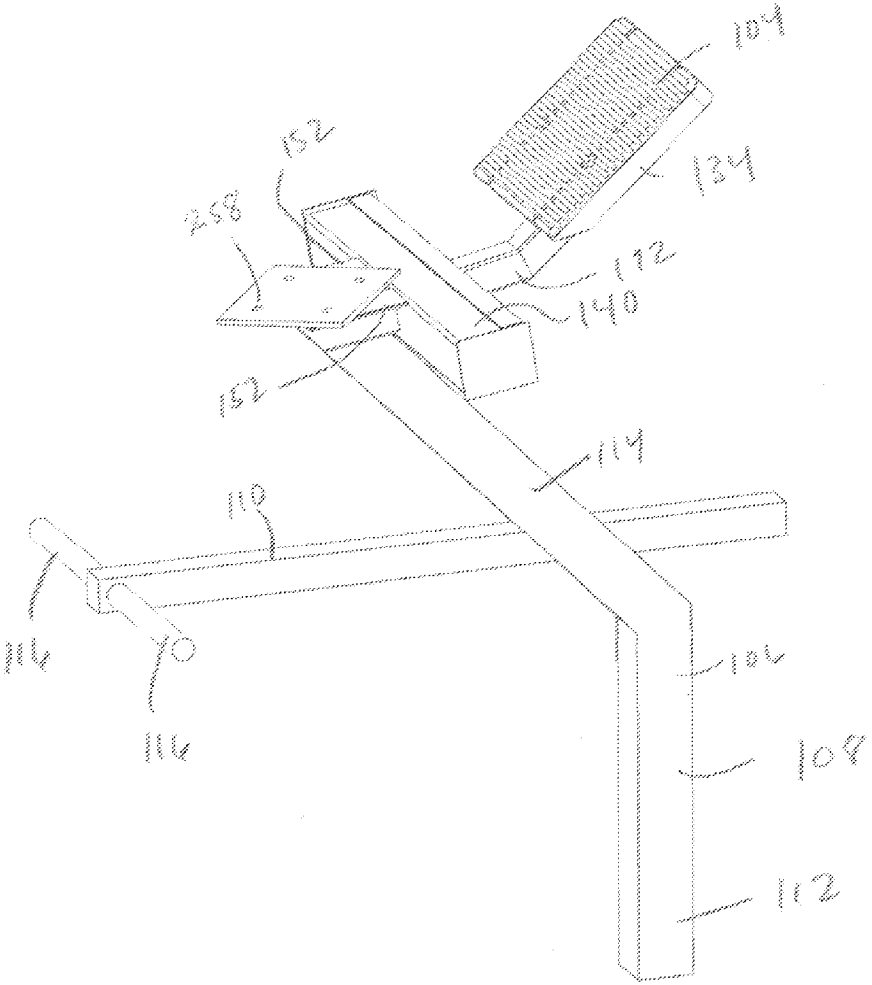
FIG. 19 is a top isometric view of the starting block system of FIG. 1, with the platform removed for clarity and further including the platform mounting plate designed to lock the adjustable plate assembly to the platform.

As shown in FIG. 16, the platform 102 is further defined by a length dimension $L_P$ of between about 20 cm to about 60 cm as measured from opposing front and rear edges thereof. In another embodiment, the length dimension $L_P$ is between about 30 cm to about 50 cm. In a further embodiment, the length dimension $L_P$ of the platform 102 is about 40 cm. Similarly, the platform 102 includes a width dimension $W_P$ of between about 30 cm to about 70 cm as measured from opposing side edges. In another embodiment, the width dimension $W_P$ is between about 40 cm to about 60 cm. In a further embodiment, the width dimension $W_P$ of the platform 102 is about 50 cm. Additionally, the platform 102 is defined by a surface area of between about 1000 $cm^2$ to about 5000 $cm^2$. In another embodiment, the surface area is between about 2000 $cm^2$ to about 4000 $cm^2$. In a further embodiment, the surface area of the platform 102 is about 3000 $cm^2$.

The size of the platform 102 with respect to the size of the back plate 134 is proportioned to allow a swimmer to easily mount the platform 102 without substantial interference from the back plate 134. The swimmer can slide the back plate 134 to one side of the platform 102, or remove the back plate 134 all together when mounting the platform 102. As compared to some prior art systems, which include back plates 134 that extend along substantially the entire width of the platforms 102, the back plate 134 disclosed herein is designed to extend only a portion of the width of the platform 102. In one embodiment, the width $W_B$ of the back plate 134 is less than half of the width $W_P$ of the platform 102. In a further embodiment, the width $W_B$ of the back plate 134 is about a third of the width $W_P$ of the platform 102. In another embodiment, the width $W_B$ of the back plate 134 is less than third the width $W_P$ of the platform 102. In a further embodiment, the width $W_B$ of the back plate 134 is about a fifth of the width $W_P$ of the platform 102.

The surface area provided to the front surface platform 102 as compared to the surface area of the back plate 134 are each proportioned to provide stability and flexibility to the starting block system 100. In one embodiment, the surface area of the front surface 224 of the back plate 134 is between about ¼th to about ⅙th of the surface area of the front surface 254 of the platform 102. In another embodiment, the surface area of the front surface 224 of the back plate 134 is about ⅕th of the surface area of the front surface 254 of the platform 102.

In some embodiments, it is envisioned that one or more components of the starting block system 100 may be retrofitted to an existing starting block that does not include an adjustable plate assembly 104. In these systems, the adjustable plate assembly 104 may be provided separate from the starting block system 100 and attached thereto. To attach the adjustable plate assembly 104 to the pedestal 106, the L-shaped brackets 152 are positioned adjacent the pedestal 106 such that the angled section 114 of the main support member 108 is within the gap 160 (see FIG. 18). Lugs 260 can be inserted through openings 156 of L-shaped brackets 152 and into the platform mounting plate 258 to lock the adjustable plate assembly 104 to the platform 102 (see FIGS. 17-19). Instructions and/or additional hardware may be included in the kit to facilitate attachment of the adjustable plate assembly 104 to an existing pedestal 106. It should be understood that this kit is designed to be used with a pedestal that was not sold with the adjustable plate assembly 104 or is otherwise missing the adjustable plate assembly 104.

Figure 20:
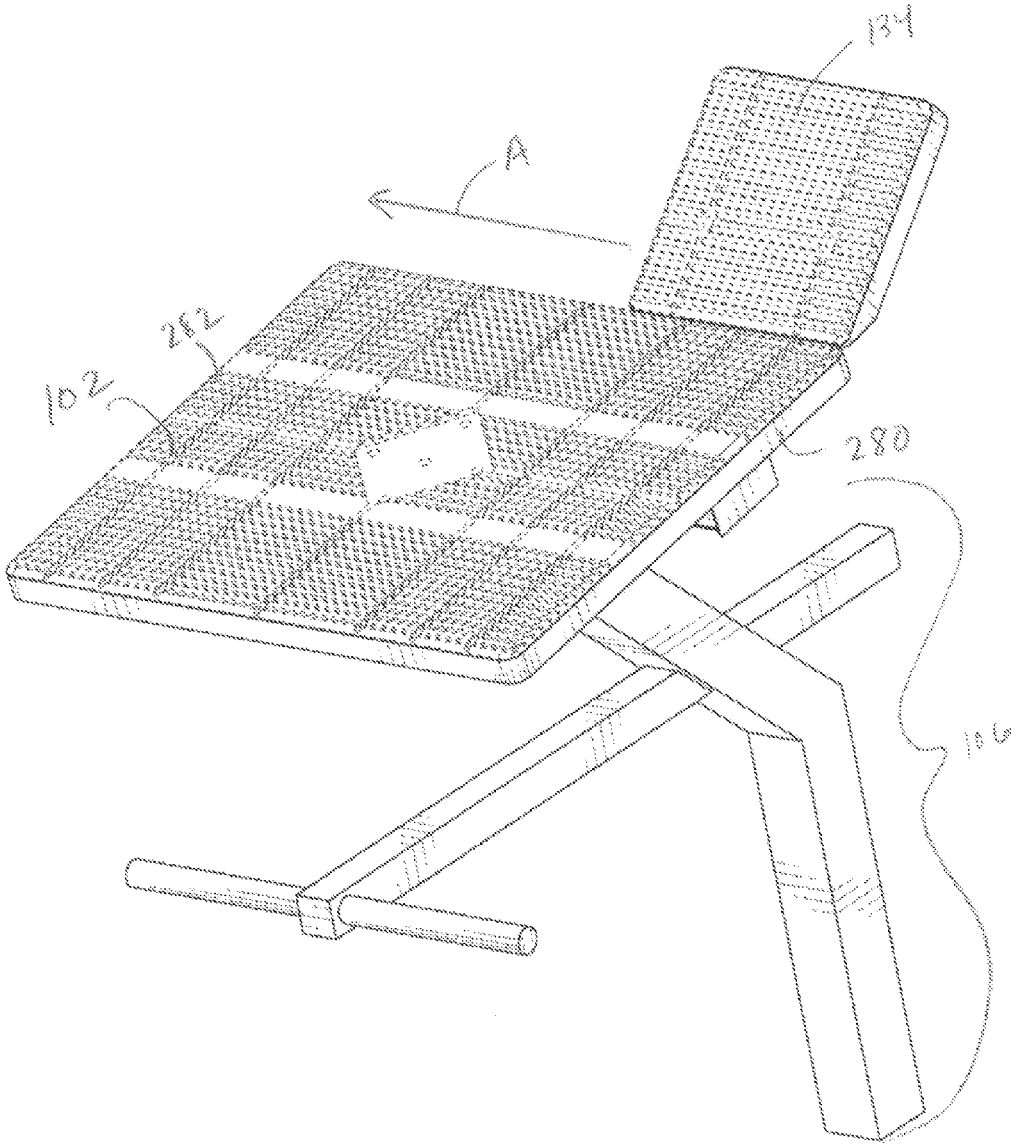
FIG. 20 is a front isometric view of the starting block system of FIG. 1 with the back plate disposed in a first position.
Figure 21:
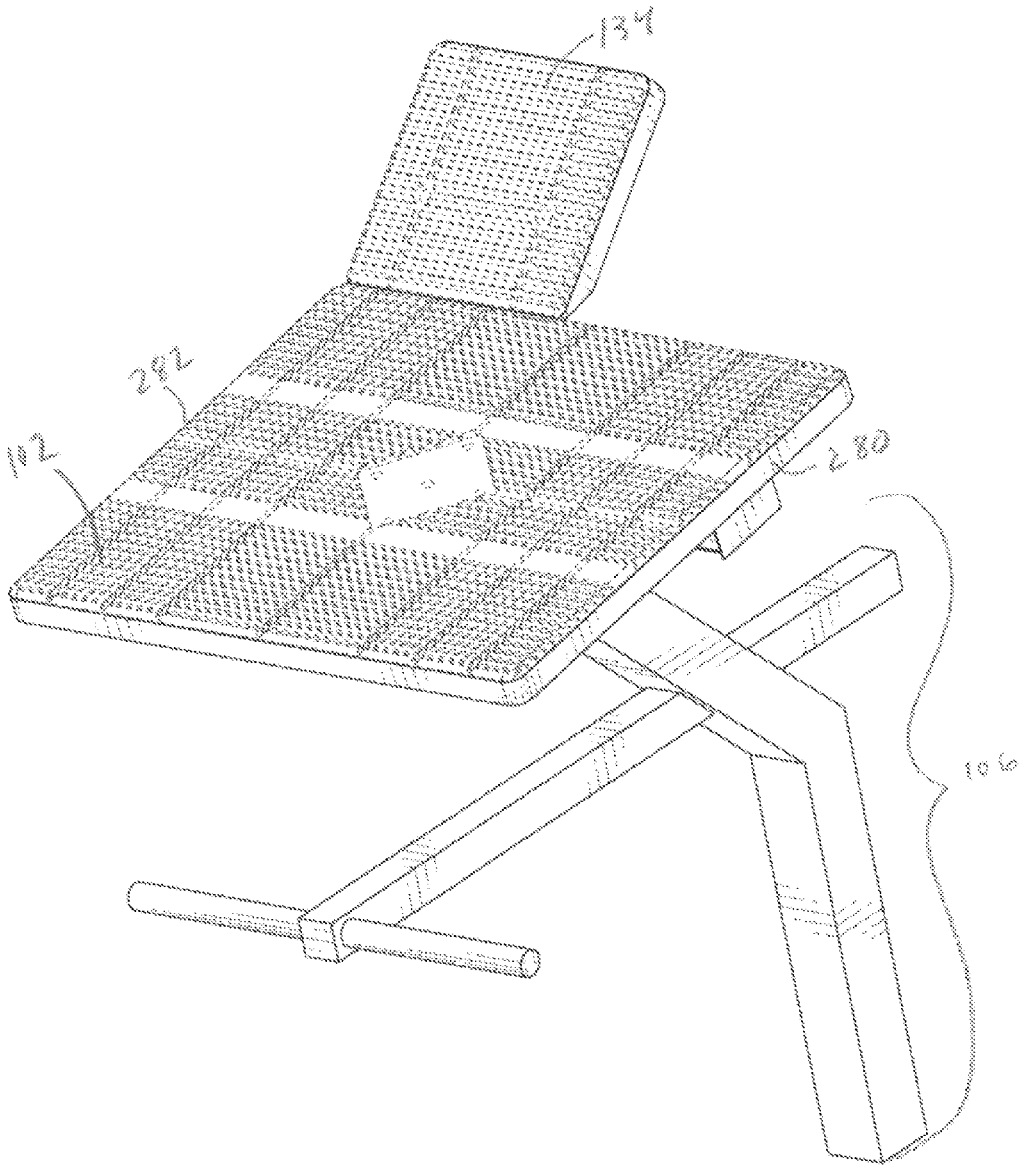
FIG. 21 is a front isometric view of the starting block system of FIG. 1 with the back plate disposed in a second position.

An additional aspect of the starting block system 100 is the lateral adjustability of the back plate 134 as compared to the platform 102. The slide plate 190 is disposed within the slot 174 formed in the rear surface 144 of the slide mechanism 130. As shown in FIG. 20, the back plate 134 is disposed in a first position adjacent a first edge 280 of the platform 102. The back plate 134 may be moved laterally as shown by arrow A such that it is disposed in a second position adjacent a second edge 282 of the platform 102 (see FIG. 20). It is also envisioned that the back plate 134 may be disposed anywhere between the first and second edges 280, 282, respectively.

In this way, the back plate 134 may be positioned in a desired location. For example, a right foot dominant swimmer may position the back plate 134 in the first position to allow the swimmer's right foot to be disposed on the back plate 134 when the swimmer is disposed on the starting block system 100. Similarly, a left foot dominant swimmer may position the back plate 134 in the second position to allow the swimmer's left foot to be disposed on the back plate 134 when the swimmer is disposed on the starting block system 100. An additional advantage is realized when the back plate 134 is able to be moved laterally when the swimmer is mounting the starting block system 100. In contrast to the prior art starting block systems, the width of the back plate 134 is smaller than the width of the platform 102, which allows the swimmer to move the back plate 134 and step onto the platform 102 from a rear position as opposed to the swimmer having to mount the starting block system 100 from the side (i.e., adjacent the hand grips 116).

In some instances, a locking mechanism (not shown) may be included to assist in retaining the back plate 134 in a specific position. In other embodiments, the back plate 134 is held into position via friction when a swimmer's foot contacts the back plate 134 prior to jumping.

Figure 22:
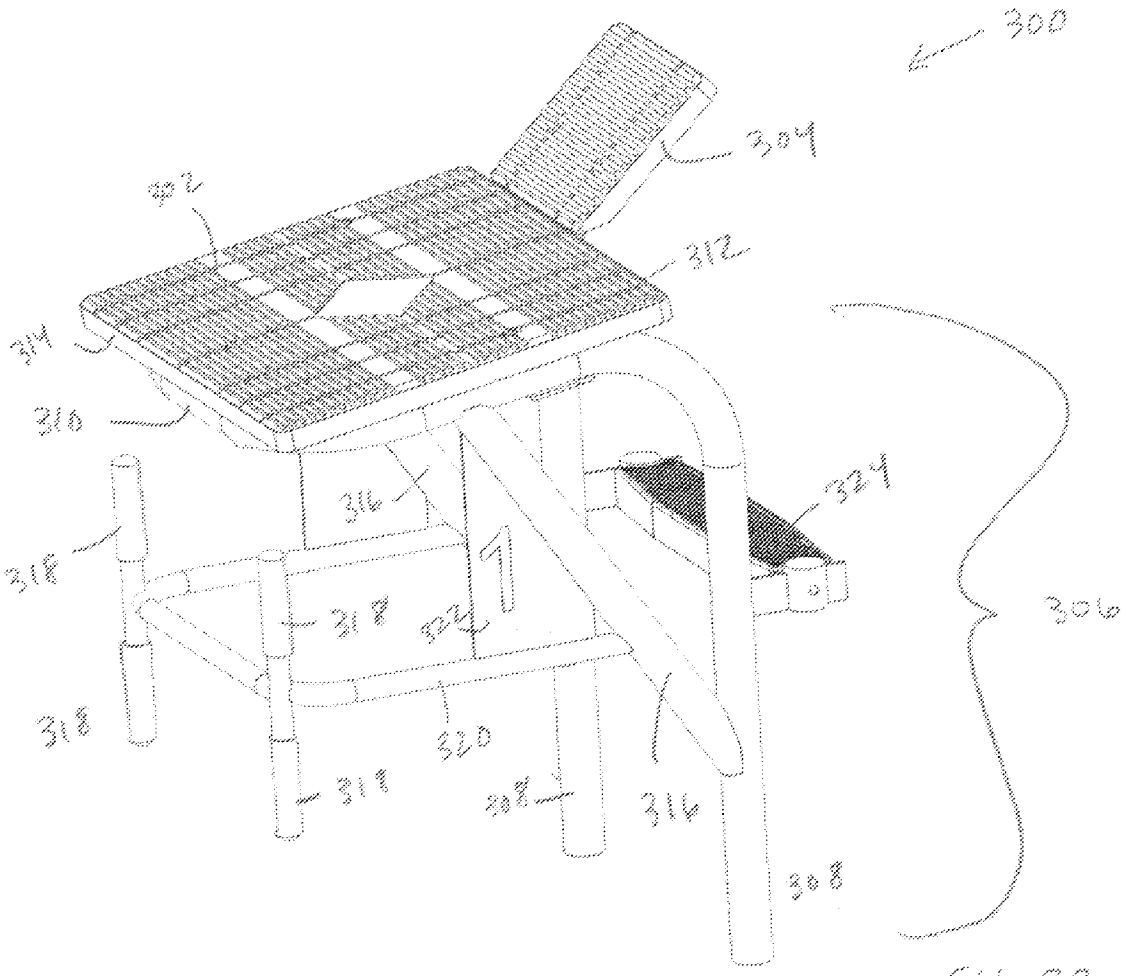
FIG. 22 is an isometric view of a starting block system according to another embodiment of the invention.

Now turning to FIGS. 22 and 23, another embodiment of a starting block system 300 is depicted. The starting block system 300 includes a platform 302 having an adjustable plate assembly 304 associated therewith and a pedestal 306 that supports the platform 302 and plate assembly 304. The platform 302 and the adjustable plate assembly 304 are substantially similar to those depicted in the embodiments shown in FIG. 1-21.

The platform 302 differs from the platform 102 in that the platform 302 is not attached to a central pedestal, but rather is supported on a tubular frame 306. The tubular frame 306 includes two opposing legs 308 that are joined by a substantially U-shaped rounded section 310 to form one uniform frame member. The opposing legs 308 protrude downwardly adjacent a rear edge 312 of the platform 302 and are designed to be anchored into the ground in manners known in the art. The rounded section 310 joins the legs 308 and provides support to the underside of the platform 302. The rounded section 310 starts adjacent the rear edge 312 of the platform 302 and extends outwardly toward a front edge 314 of the platform 302.

The platform 302 may also include one or more angled components 316 that join the legs 308 to the rounded section 310. The platform 302 optionally includes one or more handgrips 318 extending from a substantially U-shaped support member 320 that extends outwardly from the angled components 316. The platform 302 further optionally includes a number plate 322 and/or a back step 324 designed to assist a swimmer onto the platform. The platform 302 may be attached to the frame 306 in manners known in the art.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

We claim:

1. A starting block system, comprising:

a pedestal extending upwardly from a surface;

a platform for holding a swimmer that is in communication with the pedestal; and an adjustable plate assembly attached to the platform that includes a back plate that is laterally slidable from a first lateral side to a second lateral side of the platform along an outer perimeter of the platform.

2. The starting block system of claim 1, wherein the back plate is removable from the starting block system.

3. The starting block system of claim 2, wherein the back plate includes a width dimension that is less than half of a width dimension of the platform.

4. The starting block system of claim 1, wherein the adjustable plate assembly further includes a slide mechanism.

5. The starting block system of claim 4, wherein the slide mechanism includes a housing having a slot.

6. The starting block system of claim 5, wherein a portion of the back plate is designed to be retained within the slot.

7. The starting block system of claim 5, wherein a width of the housing is approximately the same as a width of the platform.

8. The starting block system of claim 5, wherein the slot extends in a lateral manner from a first side of the housing to a second side of the housing.

9. The starting block system of claim 1, wherein the back plate extends outwardly from a rear edge of the platform.

10. The starting block system of claim 1, wherein the back plate is laterally slidable along the outer perimeter of the platform adjacent a rear edge of the platform.

11. The starting block system of claim 1, wherein there is only one back plate associated with the platform.

12. The starting block system of claim 1, wherein the platform and back plate each include a coating designed to impart a gripping surface.

13. A starting block system for use with a swimming pool, comprising:

a pedestal designed to support a platform;

a back plate disposed along a rear edge of the platform, the back plate having a width dimension that is less than a width dimension of the platform; and a slide mechanism disposed adjacent the rear edge of the platform and in communication with the back plate, wherein the back plate is designed to slide laterally along an exterior of the rear edge of the platform from a first lateral side to a second lateral side of the platform.

14. The starting block system of claim 13, wherein the back plate includes a slide plate extending from the back plate.

15. The starting block system of claim 14, wherein the slide mechanism includes a housing having a lateral slot.

16. The starting block system of claim 15, wherein the slide plate is disposed within the slot of the housing.

17. The starting block system of claim 13, wherein the back plate has a front surface with a surface area that is between ¼th and ⅙th of a surface area of an upper surface of the platform.

18. The starting block system of claim 13, wherein the back plate protrudes outwardly from the rear edge of the platform.

19. The starting block system of claim 13, wherein there is only one back plate associated with the platform.

* * * * *